US006921160B2

(12) United States Patent
Tsukada

(10) Patent No.: US 6,921,160 B2
(45) Date of Patent: Jul. 26, 2005

(54) PIEZO-ELECTRIC DEVICE AND INK CARTRIDGE HAVING THE SAME

(75) Inventor: Kenji Tsukada, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 292 days.

(21) Appl. No.: 10/202,385

(22) Filed: Jul. 25, 2002

(65) Prior Publication Data

US 2003/0030703 A1 Feb. 13, 2003

(30) Foreign Application Priority Data

Aug. 1, 2001 (JP) ..... 2001-233485

(51) Int. Cl.[7] ..... B41J 2/175
(52) U.S. Cl. ..... 347/86
(58) Field of Search ..... 347/86, 68–72, 347/19, 23, 50, 40, 20, 44, 47, 27, 63; 399/261; 361/700; 310/328–330; 29/890.1

(56) References Cited

U.S. PATENT DOCUMENTS

| | | | | |
|---|---|---|---|---|
| 5,689,288 A | * | 11/1997 | Wimmer et al. | 347/7 |
| 5,793,705 A | | 8/1998 | Gazis et al. | |
| 6,044,694 A | | 4/2000 | Anderson et al. | |
| 6,234,608 B1 | * | 5/2001 | Genovese et al. | 347/54 |
| 6,470,744 B1 | | 10/2002 | Usui et al. | |
| 6,536,861 B1 | | 3/2003 | Usui et al. | |
| 6,644,289 B2 | | 11/2003 | Noda | |
| 6,675,646 B2 | | 1/2004 | Nishihara | |
| 2002/0012015 A1 | | 1/2002 | Tsukada et al. | |
| 2002/0015084 A1 | | 2/2002 | Tsukuda et al. | |
| 2002/0105555 A1 | | 8/2002 | Tsukada et al. | |
| 2002/0135623 A1 | | 9/2002 | Tsukada et al. | |
| 2003/0071862 A1 | | 4/2003 | Tsukada et al. | |
| 2003/0117450 A1 | | 6/2003 | Usui et al. | |
| 2003/0117451 A1 | | 6/2003 | Usui et al. | |
| 2003/0140694 A1 | | 7/2003 | Usui et al. | |

FOREIGN PATENT DOCUMENTS

| | | |
|---|---|---|
| CN | 1274645 A | 11/2000 |
| JP | 2001-146030 | 5/2001 |

OTHER PUBLICATIONS

Japanese Abstract No. 06297726, dated Oct. 25, 1994.
Japanese Abstract No. 2001146029, dated May 29, 2001.
Japanese Abstract No. 10305590, dated Nov. 17, 1998.
Japanese Abstract No. 2001146030, dated May 29, 2001.

* cited by examiner

*Primary Examiner*—Stephen Meier
*Assistant Examiner*—Charles Stewart, Jr.
(74) *Attorney, Agent, or Firm*—Sughrue Mion, PLLC

(57) ABSTRACT

A piezo-electric device has a base including a cavity opened on a first surface of the base, a first electrode layer formed on a second surface of the base, a piezo-electric layer laminated on the first electrode layer, and an auxiliary electrode layer formed on the second surface of the base. Between the first electrode layer and the auxiliary electrode layer, an insulating gap for ensuring the insulating state between both electrode layers is formed. The insulating gap is formed away from the position corresponding to the periphery of the cavity. The piezo-electric device can prevent a generation of cracks in the piezo-electric layer.

21 Claims, 14 Drawing Sheets

PIEZO-ELECTRIC DEVICE AND INK CARTRIDGE HAVING THE SAME

BACKGROUND OF THE INVENTION

1. Field of the Invention

The present invention relates to a piezo-electric device and an ink cartridge having the piezo-electric device, and more particularly to a piezo-electric device for liquid detection and an ink cartridge having the same.

2. Description of the Related Art

In an ink jet recorder, an ink jet recording head having a pressure generation means for pressurizing a pressure generation chamber and a nozzle opening for jetting pressurized ink as ink drops is mounted on a carriage.

The ink jet recorder is structured so as to continue printing by continuously feeding ink in an ink tank (ink container) to the recording head via a flow path. The ink tank is structured as a removable cartridge which can be simply exchanged by a user, for example, at the point of time when ink is consumed.

Conventionally, there are some management methods for ink consumption of the ink cartridge. One method is that the jet count of ink drops jetted by the recording head and the ink amount sucked in by maintenance are totalized by the software and the ink consumption is managed by calculation. The other method is that an electrode for liquid level detection is mounted on the ink cartridge, thereby managing the point of time when a predetermined amount of ink is actually consumed.

However, in the method for totalizing the jet count of ink drops and ink amount by the software and managing the ink consumption by calculation, the following problem is imposed. Some head has weight variations in injected ink drops. Weight variations in ink drops do not adversely affect the image quality. However, in consideration of a case of accumulation of errors in the ink consumption due to variations, the ink cartridge should be filled with a marginal amount of ink. Therefore, a problem arises that the marginal amount of ink remains in some cartridge.

On the other hand, the method for managing the point of time of consumption of ink by an electrode can detect the actual amount of ink. Therefore, the ink residue can be managed highly reliably. However, the detection of the ink level depends on the conductivity of ink, so that the kind of detectable ink is limited and the seal structure for the electrode is complicated. Further, as a material of the electrode, a noble metal which is highly conductive and anticorrosive is generally used, so that the manufacturing cost of the ink cartridge is increased. Furthermore, since two electrodes must be mounted, the manufacturing processes are increased, and as a result, the manufacturing cost is increased.

To solve the aforementioned problem, in Japanese Patent Application No. 2000-147052, a piezo-electric device which can accurately detect the liquid residue, requires no complicated seal structure, and is mounted in a liquid container is described.

According to the art relating to the aforementioned patent application, by use of changing of the resonance frequency of a residual vibration signal generated due to the residual vibration of the vibration part of the piezo-electric device in a case of existence of ink in the space opposite to the vibration part of the piezo-electric device and a case of non-existence of ink, the ink residue in the ink cartridge can be monitored.

FIGS. 19 and 20 are drawings showing a piezo-electric device of the related art. The piezo-electric device has a base 200 structured so as to laminate a diaphragm 202 on a substrate 201, and a cavity 203 for receiving a medium to be detected is formed on the base 200. At both ends of the base 200, a lower electrode terminal 204 and an upper electrode terminal 205 are formed. Furthermore, in the central part of the base 200, a lower electrode layer 206 connected to the lower electrode terminal 204 is formed, and a piezo-electric layer 207 is laminated on the lower electrode layer 206, and an upper electrode layer 208 is laminated on the piezo-electric layer 207.

Further, on the base 200, an auxiliary electrode layer 209 is formed, and the auxiliary electrode layer 209 electrically connects the upper electrode layer 208 and the upper electrode terminal 205, and a part thereof is positioned between the diaphragm 202 and the piezo-electric layer 207 and supports an extension part 210 of the piezo-electric layer 207 from underneath. Since the extension part 210 of the piezo-electric layer 207 is supported by the auxiliary electrode layer 209 like this, the extension part 210 is prevented from producing a stepwise part.

Further, as clearly shown in FIG. 20, the auxiliary electrode layer 209 is formed so as to be positioned outside the region corresponding to the cavity 203. The reason is that since the diaphragm 202 in the region corresponding to the cavity 203 and the piezo-electric layer 207 constitute the vibration part of the piezo-electric device, the auxiliary electrode layer 209 is formed outside the region of the vibration part, thus the vibration characteristic of the piezo-electric device is prevented from deterioration.

However, in the aforementioned conventional piezo-electric device, when the piezo-electric device is driven and the vibration part is vibrated, a problem arises that at the position of the arrow A shown in FIG. 20, cracks are easily generated on the piezo-electric layer 207 and the upper electrode layer 208.

The cause of generation of cracks is considered as indicated below. Namely, as shown in FIG. 20, between the lower electrode layer 206 and the auxiliary electrode layer 209, a gap 211 for ensuring an insulating state between the two is formed and the gap 211 is formed so as to include the position corresponding to a periphery 203*a* of the cavity 203. Therefore, when the vibration part of the piezo-electric device is vibrated by driving the piezo-electric device, stress concentration is generated on the piezo-electric layer 207 at the position corresponding to the periphery 203*a* of the cavity 203 and this is considered to cause generation of cracks.

Further, as clearly shown in FIG. 19, in the conventional piezo-electric device, in the region corresponding to the cavity 203, the piezo-electric layer 207, the lower electrode layer 206, and the upper electrode layer 208 constituting the vibration part are formed in an asymmetrical shape as a whole. Therefore, a problem arises that the weight balance in the vibration part of the piezo-electric device gets worse and the vibration characteristic of the vibration part is deteriorated.

The present invention was developed with the foregoing in view and is intended to provide a piezo-electric device for preventing a generation of cracks in a piezo-electric layer and improving a vibration characteristic of a vibration part of the piezo-electric device.

SUMMARY OF THE INVENTION

To solve the aforementioned problems, the piezo-electric device of the present invention comprises: a base having a first surface and a second surface positioned opposite to each other, said base including a cavity for receiving a medium to be detected, said cavity having a bottom and being formed so as to be opened on a side of said first surface, said bottom of said cavity being formed so as to vibrate, a first electrode layer formed on a side of said second surface, said first electrode having a body formed in a region corresponding to said cavity, a piezo-electric layer laminated on said first electrode layer, said piezo-electric layer having a body formed in a region corresponding to said cavity and an extension part extending from said body beyond a position corresponding to a periphery of said cavity, an auxiliary electrode layer formed on a side of said second surface of said base, at least a part of said auxiliary electrode layer being positioned between said second surface and said extension part of said piezo-electric layer so as to support said extension part of said piezo-electric layer, and a second electrode layer laminated on said piezo-electric layer and connected to said auxiliary electrode layer, wherein, between said first electrode layer and said auxiliary electrode layer, an insulating gap for ensuring an insulating state between said first electrode layer and said auxiliary electrode layer is formed, said insulating gap being formed away from said position corresponding to said periphery of said cavity.

Preferably, said insulating gap is positioned as a whole in a region corresponding to said cavity.

Preferably, said auxiliary electrode layer has a projection projected from an outside of said region corresponding to said cavity to an inside thereof beyond said position corresponding to said periphery of said cavity.

Preferably, said projection of said auxiliary electrode layer has round corners.

Preferably, said projection of said auxiliary electrode layer is formed wider than said extension part of said piezo-electric layer.

Preferably, said projection of said auxiliary electrode layer is formed narrower than said extension part of said piezo-electric layer.

Preferably, said first electrode layer has an extension part extending from an inside of said region corresponding to said cavity toward said auxiliary electrode layer beyond said position corresponding to said periphery of said cavity; and said insulating gap is formed between said extension part of said first electrode layer and said auxiliary electrode layer and positioned as a whole outside said region corresponding to said cavity.

Preferably, a portion of said first electrode layer, a portion of said second electrode layer, and a portion of said auxiliary electrode layer, which are positioned in said region corresponding to said cavity, are formed as a whole in an almost symmetrical shape having at least one axis of symmetry passing a center of said body of said piezo-electric layer.

Preferably, a portion of said piezo-electric layer positioned in said region corresponding to said cavity is formed in an almost symmetrical shape having said at least one axis of symmetry.

Preferably, said at least one axis of symmetry includes a first axis of symmetry extending in an extension direction of said extension part of said piezo-electric layer and a second axis of symmetry orthogonal to said first axis of symmetry.

To solve the aforementioned problems, the piezo-electric device of the present invention comprises: a base having a first surface and a second surface positioned opposite to each other, said base including a cavity for receiving a medium to be detected, said cavity having a bottom and being formed so as to be opened on a side of said first surface, said bottom of said cavity being formed so as to vibrate, a first electrode layer formed on a side of said second surface, said first electrode having a body formed in a region corresponding to said cavity, a piezo-electric layer laminated on said first electrode layer, said piezo-electric layer having a body formed in said region corresponding to said cavity and an extension part extending from said body beyond a position corresponding to a periphery of said cavity, an auxiliary electrode layer formed on a side of said second surface of said base, at least a part of said auxiliary electrode being positioned between said second surface and said extension part of said piezo-electric layer so as to support said extension part of said piezo-electric layer, and a second electrode layer laminated on said piezo-electric layer and connected to said auxiliary electrode layer, wherein a portion of said first electrode layer, a portion of said second electrode layer, and a portion of said auxiliary electrode layer, which are positioned in said region corresponding to said cavity, are formed as a whole in an almost symmetrical shape having at least one axis of symmetry passing a center of said body of said piezo-electric layer.

Preferably, a portion of said piezo-electric layer positioned in said region corresponding to said cavity is formed in an almost symmetrical shape having said at least one axis of symmetry.

Preferably, said at least one axis of symmetry includes a first axis of symmetry extending in an extension direction of said extension part of said piezo-electric layer and a second axis of symmetry orthogonal to said first axis of symmetry.

To solve the aforementioned problems, the piezo-electric device of the present invention comprises: a base having a first surface and a second surface positioned opposite to each other, said base including a cavity for receiving a medium to be detected, said cavity having a bottom and being formed so as to be opened on a side of said first surface, said bottom of said cavity being formed so as to vibrate, a first electrode layer formed on a side of said second surface, said first electrode having a body formed in a region corresponding to said cavity, a piezo-electric layer laminated on said first electrode layer, said piezo-electric layer having a body formed in a region corresponding to said cavity and an extension part extending from said body beyond a position corresponding to a periphery of said cavity, an auxiliary electrode layer formed on a side of said second surface of said base, at least a part of said auxiliary electrode layer being positioned between said second surface and said extension part of said piezo-electric layer so as to support said extension part of said piezo-electric layer, and a second electrode layer laminated on said piezo-electric layer and connected to said auxiliary electrode layer, wherein a portion of said piezo-electric layer positioned in said region corresponding to said cavity is formed in an almost symmetrical shape having at least one axis of symmetry passing a center of said body of said piezo-electric layer.

Preferably, said at least one axis of symmetry includes a first axis of symmetry extending in an extension direction of said extension part of said piezo-electric layer and a second axis of symmetry orthogonal to said first axis of symmetry.

To solve the aforementioned problems, the ink cartridge used for an ink jet recording apparatus of the present invention, comprises: an ink container for containing ink; and the above-mentioned piezo-electric device, wherein said cavity of said piezo-electric device is exposed in an ink containing space of said ink container.

To solve the aforementioned problems, an ink cartridge used for an ink jet recording apparatus of the present invention, comprises: an ink container for containing ink; and the above-mentioned piezo-electric device, wherein said cavity of said piezo-electric device is exposed in an ink containing space of said ink container.

To solve the aforementioned problems, an ink cartridge used for an ink jet recording apparatus of the present invention, comprises: an ink container for containing ink; and the above-mentioned piezo-electric device, wherein said cavity of said piezo-electric device is exposed in an ink containing space of said ink container.

DESCRIPTION OF THE PREFERRED EMBODIMENTS

A piezo-electric device according to an embodiment of the present invention and an ink cartridge having the piezo-electric device will be explained hereunder with reference to the accompanying drawings.

Figure 1:
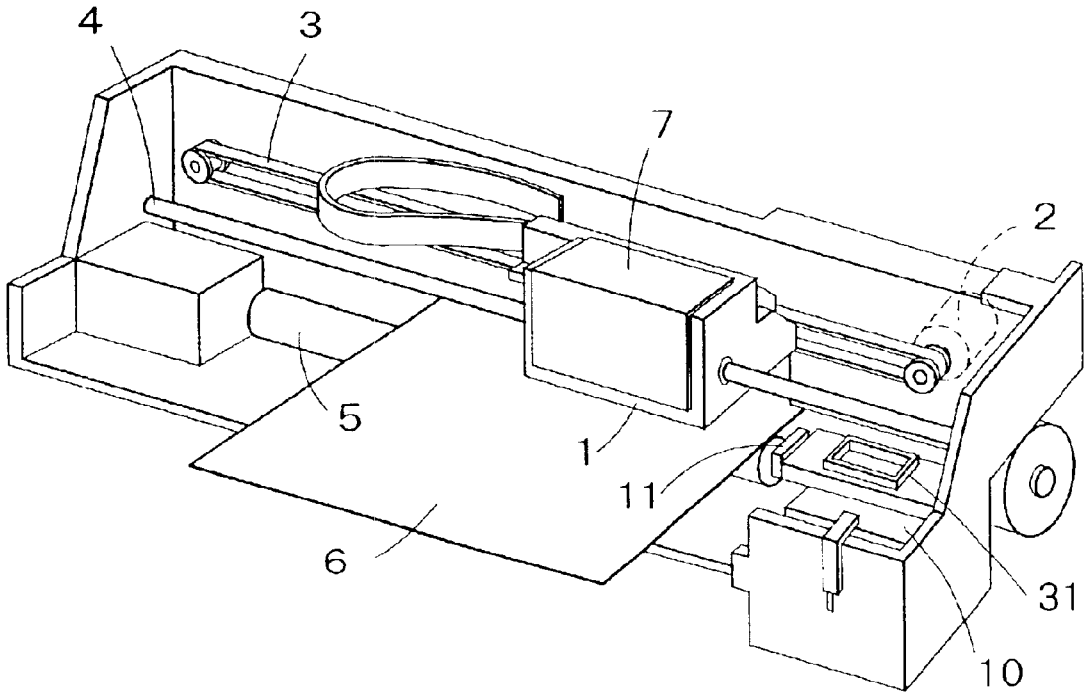
FIG. 1 is a perspective view showing a schematic constitution of an ink jet recorder using an ink cartridge of an embodiment of the present invention.

Numeral 1 shown in FIG. 1 indicates a carriage and the carriage 1 is structured so as to moves back and forth in the axial direction of a platen 5 by being guided by a guide member 4 via a timing belt 3 driven by a carriage motor 2.

On the opposite side to a recording paper 6 of the carriage 1, an ink jet recording head is loaded and above it, an ink cartridge 7 for feeding ink to the recording head is mounted in a removable state.

In the home position (on the right in the drawing) which is a non-printing region of the recorder, a cap member 31 is arranged and the cap member 31 is structured, when the recording head loaded on the carriage 1 is moved to the home position, so as to be pressed against the nozzle forming surface of the recording head and form a closed space between the nozzle forming surface and itself. And, under the cap member 31, a pump unit 10 for applying negative pressure to the closed space formed by the cap member 31 and executing cleaning is arranged.

And, in the neighborhood of the cap member 31 on the printing region side, a wiping means 11 having an elastic plate of rubber is arranged so as to move forward or backward, for example, in a horizontal direction to the moving track of the recording head and when the carriage 1 moves back and forth on the side of the cap member 31, the wiping means 11 is structured so as to wipe out the nozzle forming surface of the recording head when necessary.

Figure 2:
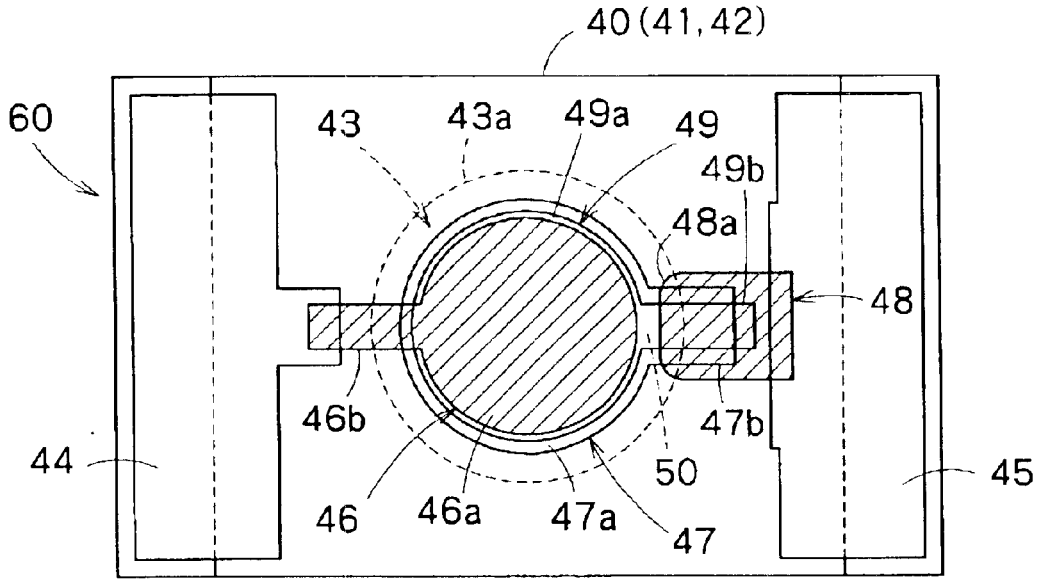
FIG. 2 is a drawing showing a piezo-electric device of an embodiment of the present invention.
Figure 3:
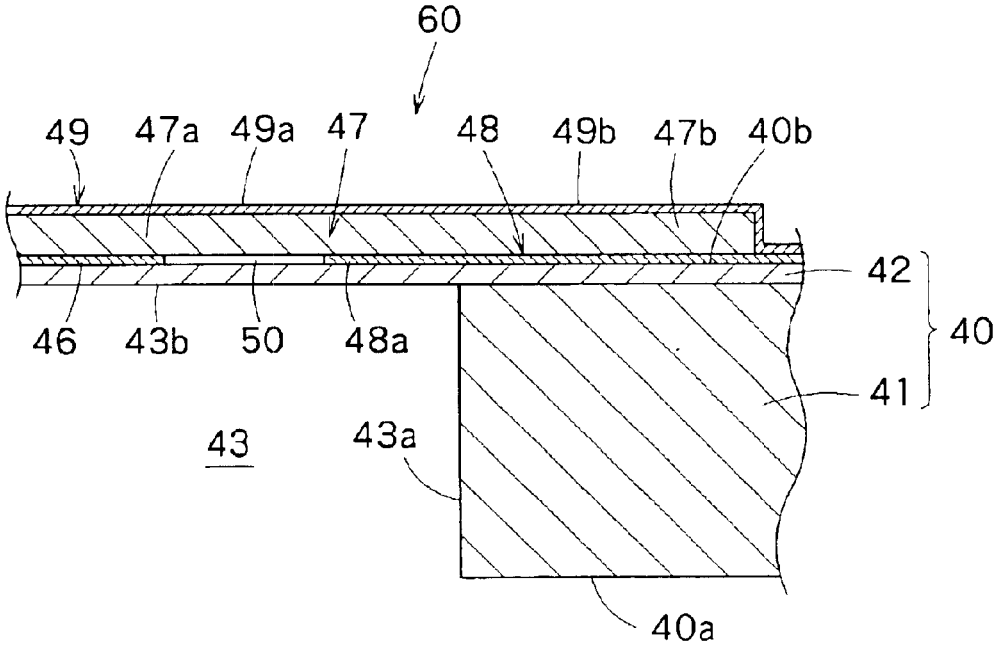
FIG. 3 is a sectional view showing an enlarged part of the piezo-electric device shown in FIG. 2.

FIGS. 2 and 3 are drawings showing the piezo-electric device of this embodiment, and a piezo-electric device 60 has a base 40 structured so as to laminate a diaphragm 42 on a substrate 41, and the base 40 has a first surface 40*a* and a second surface 40*b* opposite to each other. On the base 40, a circular cavity 43 for receiving a medium to be detected is formed so as to be opened on the side of the first surface 40*a* and a bottom 43*b* of the cavity 43 is formed so as to be vibrated by the diaphragm 42. At both ends of the base 40 on the side of a second surface 40*b*, a lower electrode terminal 44 and an upper electrode terminal 54 are formed.

On the second surface 40*b* of the base 40, a lower electrode layer (first electrode layer) 46 is formed and the lower electrode layer 46 has a body 46*a* formed in the region corresponding to the cavity 43 and an extension part 46*b* extending from the body 46*a* beyond the position corresponding to a periphery 43*a* of the cavity 43. The body 46*a* of the lower electrode layer 46 is circular and the center thereof almost coincides with the center of the cavity 43. The body 46*a* of the lower electrode layer 46 is structured so as to have a smaller diameter than that of the cavity 43.

On the lower electrode layer 46, a piezo-electric layer 47 is laminated and the piezo-electric layer 47 has a body 47*a* formed in the region corresponding to the cavity 43 and an extension part 47*b* extending from the body 47*a* beyond the position corresponding to the periphery 43*a* of the cavity 43. The body 47*a* of the piezo-electric layer 47 is circular and the center thereof almost coincides with the center of the cavity 43. The body 47*a* of the piezo-electric layer 47 is formed so as to have a smaller diameter than that of the cavity 43 and a larger diameter than that of the body 46*a* of the lower electrode layer 46.

On the side of the second surface 40*b* of the base 40, an auxiliary electrode layer 48 is formed and the auxiliary electrode layer 48 preferably has the same material and same thickness as those of the lower electrode layer 46. A part of the auxiliary electrode layer 48 is positioned between the second surface 40*b* and the extension part 47*b* of the piezo-electric layer 47 and supports the extension part 47*b* of the piezo-electric layer 47 from underneath. Since the extension part 47*b* of the piezo-electric layer 47 is supported by a part of the auxiliary electrode layer 48, the piezo-electric layer 47 is prevented from generating a level difference.

On the piezo-electric layer 47, an upper electrode layer (second electrode layer) 49 is laminated and the upper electrode layer 49 has a body 49*a* formed on the body 47*a* of the piezo-electric layer 47 and an extension part 49*b* extending from the body 49*a* beyond the position corresponding to the periphery 43*a* of the cavity 43. The extension part 49 of the upper electrode layer 49 is connected to the auxiliary electrode layer 48 and the upper electrode layer 49 and the upper electrode terminal 45 are electrically connected via the auxiliary electrode layer 48. Since the upper electrode layer 49 is connected to the upper electrode terminal 45 via the auxiliary electrode layer 48 like this, the level difference generated from the total thickness of the piezo-electric layer 47 and the lower electrode layer 46 can be absorbed by both the upper electrode layer 49 and the auxiliary electrode layer 48. Therefore, generation of a large level difference in the upper electrode layer 49 and reduction in the mechanical strength can be prevented.

The body 49*a* of the upper electrode layer 49 is circular and the center thereof almost coincides with the center of the cavity 43. The body 49*a* of the upper electrode layer 49 is formed so as to have a smaller diameter than the body 47*a* of the piezo-electric layer 47 and the cavity 43 and a larger diameter than the body 46*a* of the lower electrode layer 46.

As mentioned above, the body 47*a* of the piezo-electric layer 47 is structured so as to be held between the body 49*a* of the upper electrode layer 49 and the body 46*a* of the lower electrode layer 46. By doing this, the piezo-electric layer 47 can be effectively deformed and driven.

As mentioned above, among the body 49*a* of the upper electrode layer 49, the body 47*a* of the piezo-electric layer 47, the body 46*a* of the lower electrode layer 46, and the cavity 43, the one having a largest area is the cavity 43. Due to such a structure, the vibration region of the diaphragm 42 which vibrates actually is decided by the cavity 43.

Further, since the areas of the body 49*a* of the upper electrode layer 49, the body 47*a* of the piezo-electric layer 47, and the body 46*a* of the lower electrode layer 46 are smaller than the area of the cavity 43, the diaphragm 42 can vibrate more easily.

Furthermore, among the body 46*a* of the lower electrode layer 46 and the body 49*a* of the upper electrode layer 49 electrically connected to the piezo-electric layer 47, the body 46*a* of the lower electrode layer 46 is smaller. Therefore, the body 46*a* of the lower electrode layer 46 decides the part of the piezo-electric layer 47 which produces the piezo-electric effect.

The centers of the body 47*a* of the piezo-electric layer 47, the body 49*a* of the upper electrode layer 49, and the body 46*a* of the lower electrode layer 46 almost coincide with the center of the cavity 43. Further, the center of the circular cavity 43 for deciding the vibration part of the diaphragm 42 is positioned almost at the center of the whole piezo-electric device 60. Therefore, the center of the vibration part of the piezo-electric device 60 almost coincides with the center of the piezo-electric device 60.

Further, the vibration parts of the body 47*a* of the piezo-electric layer 47, the body 49*a* of the upper electrode layer 49, the body 46*a* of the lower electrode layer 46, and the diaphragm 42 respectively have a circular shape, so that the vibration part of the piezo-electric device 60 has a symmetrical shape about the center of the piezo-electrical device 60. As mentioned above, the vibration part of the piezo-electric device 60 has a symmetrical shape about the center of the piezo-electrical device 60, so that an unnecessary vibration which may be caused by asymmetry of the structure will not be excited. Therefore, the detection accuracy of the resonance frequency is improved.

Further, the vibration part of the piezo-electric device 60 is isotropic, so that when the piezo-electric device 60 is bonded, it is hardly affected by variations in fixing and can be uniformly bonded to the ink container. Namely, the mounting capacity of the piezo-electric device 60 to the ink container is satisfactory.

Further, the compliance of the diaphragm 42 is large, so that the damping of vibration is reduced and the detection accuracy of the resonance frequency can be improved.

The members included in the piezo-electric device 60 are preferably calcined mutually and integratedly formed. When the piezo-electric device 60 is integratedly formed, it can be handled easily.

Further, when the strength of the substrate 41 is increased, the vibration characteristic can be improved. Namely, when the strength of the substrate 41 is increased, only the vibration part of the piezo-electric device 60 vibrates and the parts of the piezo-electric device 60 other than the vibration part do not vibrate. Further, to make the vibration of the vibration part larger, in addition to increasing the strength of the substrate 41, it is effective to make the piezo-electric layer 47, the upper electrode layer 49, and the lower electrode layer 46 of the piezo-electric device 60 thinner and smaller and make the diaphragm 41 thinner.

As a material of the piezo-electric layer 47, it is preferable to use lead zirconate titanate (PZT), lead lanthanum zirconate titanate (PLZT), or a lead-less piezo-electric film using no lead. As a material of the substrate 41, it is preferable to use zirconia or alumina. Further, it is preferable to use the same material as that of the substrate 41 for the diaphragm 42. For the upper electrode layer 49, the lower electrode layer 46, the upper electrode terminal 45, and the lower electrode terminal 44, a conductive material, for example, a metal such as gold, silver, copper, platinum, aluminum, or nickel can be used.

As shown in FIG. 3, between the lower electrode layer 46 and the auxiliary electrode layer 48, an insulating gap 50 is formed. And, the insulating gap 50 is formed away from the position corresponding to the periphery 43*a* of the cavity 43. More concretely, the insulating gap 50 is formed so that the whole thereof is positioned in the region corresponding to the cavity 43.

When the whole insulating gap 50 is positioned in the region corresponding to the cavity 43 like this and the vibration part is vibrated by driving the piezo-electric device 60, the stress concentration generated in the piezo-electric layer 47 at the position corresponding to the periphery 43*a* of the cavity 43 can be greatly suppressed. Therefore, a generation of cracks in the piezo-electric layer 47 and the upper electrode layer 49 can be prevented.

Further, the auxiliary electrode layer 48 has a projection 48*a* projected from the outside of the region corresponding to the cavity 43 to the inside thereof beyond the position corresponding to the periphery 43*a* of the cavity 43 and the projection 48*a* has round corners.

When the corners of the projection 48*a* of the auxiliary electrode layer 48 are made round like this, a generation of cracks in the piezo-electric layer 47 in the edge part of the auxiliary electrode layer 48 can be prevented. Furthermore, in consideration of a case of an occurrence of displacement at the time of forming of the auxiliary electrode layer 48, when the projection 48*a* of the auxiliary electrode layer 48 has corners, the corners of the projection 48*a* are moved either inside or outside the region corresponding the cavity 43 due to displacement during forming. Therefore, variations may be generated in the vibration characteristic for each piezo-electric device 60. On the other hand, when the corners of the projection 48*a* of the auxiliary electrode layer 48 are made round like this embodiment, variations in the vibration characteristic caused by the displacement during forming of the auxiliary electrode layer 48 can be suppressed greatly.

Figure 4:
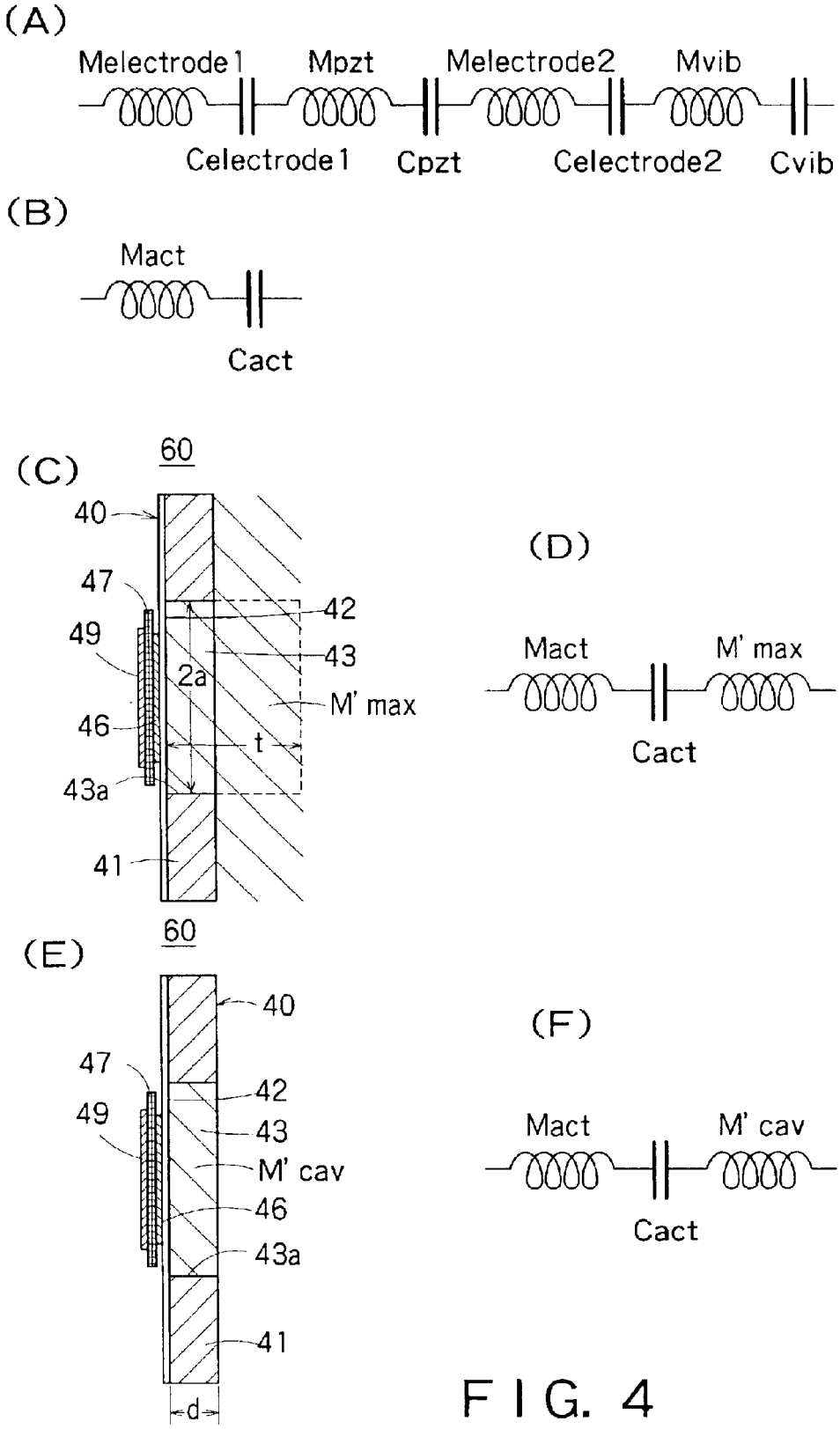
FIGS. 4(A), (B), (C), (D), (E), and (F) are drawings showing the periphery of the piezo-electric device shown in FIGS. 2 and 3 and the equivalent circuit thereof.

FIG. 4 shows the piezo-electric device 60 used in this embodiment and the equivalent circuit thereof. The piezo-electric device 60 detects the resonance frequency due to the residual vibration, thereby detects changes in the acoustic impedance, and detects the consumption state of a liquid in the ink cartridge.

In FIGS. 4, (A) and (B) show the equivalent circuit of the piezo-electric device 60. Further, in FIG. 4, (C) and (D) respectively show the periphery including the piezo-electric device 60 and the equivalent circuit thereof when the ink cartridge is full of ink and, in FIG. 4, (E) and (F) respectively show the periphery including the piezo-electric device 60 and the equivalent circuit thereof when the ink cartridge contains no ink.

The piezo-electric device 60 shown in FIGS. 2 to 4 is mounted at a predetermined place of the ink container of the ink cartridge 7 so that the cavity 43 makes contact with a liquid (ink) contained in the ink container. Namely, at least one part of the vibration part of the piezo-electric device 60 is exposed in the containing space of the ink container. When a sufficient liquid is contained in the ink container, the inside and outside of the cavity 43 are full of a liquid.

On the other hand, when the liquid in the ink container is consumed and the liquid level lowers below the mounting position of the piezo-electric device, the device enters into a state that no liquid exists in the cavity 43 or a liquid remains only in the cavity 43 and gas exists outside thereof.

The piezo-electric device 60 detects a difference in the acoustic impedance due to this state change. Thereby, the piezo-electric device 60 can detect a state that a liquid is contained fully in the ink container or a state that more than a fixed amount of liquid is consumed.

Next, the principle of liquid level detection by the piezo-electric device will be explained.

The piezo-electric device 60 can detect changes in the acoustic impedance of a liquid using changes in the resonance frequency. The resonance frequency can be detected by measuring the counter electromotive force generated by the residual vibration remaining in the vibration part after the vibration part of the piezo-electric device vibrates. Namely, the piezo-electric layer 47 of the piezo-electric device 60 generates counter electromotive force by the residual vibration remaining in the vibration part of the piezo-electric device 60. The magnitude of the counter electromotive force is changed depending on the amplitude of the vibration part of the piezo-electric device 60. Therefore, as the amplitude of the vibration part of the piezo-electric device 60 is increased, the detection is made easier.

Further, depending on the frequency of the residual vibration of the vibration part of the piezo-electric device 60, the changing period of the magnitude of the counter electromotive force is changed. Namely, the frequency of the vibration part of the piezo-electric device 60 corresponds to the frequency of the counter electromotive force. In this case, the resonance frequency is referred to as a frequency in a resonance state of the vibration part of the piezo-electric device 60 and a medium in contact with the vibration part.

The vibration region of the piezo-electric device 60 is the part of the diaphragm 42 corresponding to the cavity 43. When the ink container is filled with a liquid sufficiently, the cavity 43 is full of a liquid and the vibration region is in contact with the liquid in the ink container. On the other hand, when the ink container is not sufficiently filled with a liquid, the vibration region is in contact with the liquid remaining in the cavity 43 in the ink container or in contact with gas or a vacuum instead of a liquid.

Next, by referring to FIGS. 2 to 4, from the resonance frequency of the medium and the vibration part of the piezo-electric device 60 which is obtained by measurement of the counter electromotive force, the operation and principle for detecting the liquid state in the ink container will be explained.

In the piezo-electric device 60, a voltage is applied respectively to the upper electrode layer 49 and the lower electrode layer 46 via the upper electrode terminal 45 and the lower electrode terminal 44. Then, an electric field is generated in the part of the piezo-electric layer 47 which is held between the upper electrode layer 49 and the lower electrode layer 46. By this electric field, the piezo-electric layer 47 is deformed. When the piezo-electric layer 47 is deformed, the vibration region of the diaphragm 42 executes a flexible vibration. For a little while after deformation of the piezo-electric layer 47, the flexible vibration remains in the vibration part of the piezo-electric device 60.

The residual vibration is a free vibration between the vibration part of the piezo-electric device 60 and the medium. Therefore, when the voltage to be applied to the piezo-electric layer 47 is set to a pulse waveform or a square wave, a resonance state between the vibration part and the medium after applying the voltage can be obtained easily. The residual vibration is a vibration of the vibration part of the piezo-electric device 60 and it is accompanied by deformation of the piezo-electric layer 47. Therefore, the piezo-electric layer 47 generates counter electromotive force. The counter electromotive force is detected via the upper electrode layer 49, the lower electrode layer 46, the upper electrode terminal 45, and the lower electrode terminal 44. By the detected counter electromotive force, the resonance frequency can be identified. On the basis of the resonance frequency, the existence of a liquid in the ink container can be detected.

Generally, the resonance frequency fs is expressed by:

$$fs=1/(2*\pi*(M*Cact)^{1/2}) \quad \text{Formula 1}$$

where M indicates the sum of inertance Mact of the vibration part and additional inertance M' and Cact indicates compliance of the vibration part.

In FIG. 4, (A) and (B) show the equivalent circuit of the vibration part of the piezo-electric device 60 and the cavity 43 when no ink remains in the cavity 43.

Mact indicates a quotient obtained by dividing the product of the thickness of the vibration part and the density of the vibration part by the area of the vibration part and is expressed in detail by the following formula as shown in FIG. 4(A):

$$Mact=Mpzt+Melectrode1+Melectrode2+Mvib \quad 2$$

In this case, Mpzt indicates a quotient obtained by dividing the product of the thickness of the piezo-electric layer 47 in the vibration part and the density of the piezo-electric layer 47 by the area of the piezo-electric layer 47. Melectrode1 indicates a quotient obtained by dividing the product of the thickness of the upper electrode layer 49 in the vibration part and the density of the upper electrode layer 49 by the area of the upper electrode layer 49. Melectrode2 indicates a quotient obtained by dividing the product of the thickness of the lower electrode layer 46 in the vibration part and the density of the lower electrode layer 46 by the area of the lower electrode layer 46. Mvib indicates a quotient obtained by dividing the product of the thickness of the diaphragm 42 in the vibration part and the density of the diaphragm 42 by the area of the vibration region of the diaphragm 42.

However, Mact can be calculated from the total thickness, density, and area of the vibration region, the respective areas of the piezo-electric layer 47, so that although the upper electrode layer 49, the lower electrode layer 46, and the vibration region of the diaphragm 42 have the aforementioned magnitude relations, the mutual differences in the area are preferably minute.

Further, in this embodiment, in the piezo-electric layer 47, the upper electrode layer 49, and the lower electrode layer 46, the parts other than the circular bodies 47*a*, 49*a*, and 46*a* which are main parts thereof are preferably so minute as to be ignored for the main parts. Therefore, in the piezo-electric device 60, Mact is the sum of the respective inertances of the upper electrode layer 49, the lower electrode layer 46, the piezo-electric layer 47, and the vibration region of the diaphragm 42. Further, the compliance Cact is compliance of the part formed by the upper electrode layer 49, the lower electrode layer 46, the piezo-electric layer 47, and the vibration region of the diaphragm 42.

Further, in FIGS. 4, (A), (B), (D), and (F) show the equivalent circuits of the vibration part of the piezo-electric device 60 and the cabinet 43 and in the equivalent circuits, Cact indicates compliance of the vibration part of the piezo-electric device 60. Cpzt, Celectrode1, Celectrode2, and Cvib respectively indicate compliances of the piezo-electric layer 47 in the vibration part, the upper electrode layer 49, the lower electrode layer 46, and the diaphragm 42. Cact is expressed by Formula 3 indicated bellow.

$$1/Cact=(1/Cpzt)+(1/Celectrode1)+(1/Celectrode2)+(1/Cvib) \quad \text{Formula 3}$$

From Formulas 2 and 3, FIG. 4(A) can be indicated as FIG. 4 (B).

The compliance Cact indicates the volume of a medium which can be accepted by the deformation when the unit area is pressurized. Namely, the compliance Cact indicates the easiness of deformation.

FIG. 4(C) shows a sectional view of the piezo-electric device 60 when the ink container is sufficiently filled with a liquid and the periphery of the vibration region of the piezo-electric device 60 is full of a liquid. M'max shown in FIG. 4(C) indicates a maximum value of the additional inertance (obtained by dividing the additional weight (weight adversely affecting the vibration of the vibration region) by the square of area) when the ink container is sufficiently filled with a liquid and the periphery of the vibration region of the piezo-electric device 60 is full of a liquid. M'max is expressed as follows:

$$M'max=(\pi*\rho/(2*k^3))*(2*(2*k*a)^3/(3*\pi))/(\pi*a^2)^2 \quad \text{Formula 4}$$

where "a" indicates a radius of the vibration part, ρ density of the medium, and k a wave-number.

Further, Formula 4 is held when the vibration region of the piezo-electric device 60 is a circle with the radius of "a". The additional inertance M' is a quantity indicating that the weight of the vibration part is increased apparently by the medium in the neighborhood of the vibration part. As Formula 4 shows, M'max greatly varies with the radius "a" of the vibration part and the density ρ of the medium.

The wave-number k is expressed as follows:

$$k=2*\pi*fact/c \quad \text{Formula 5}$$

where fact indicates a resonance frequency of the vibration part and c indicates an acoustic speed propagating in the medium.

FIG. 4(D) shows the equivalent circuit of the vibration part of the piezo-electric device 60 and the cavity 43 in FIG. (C) that the ink container is sufficiently filled with a liquid and the periphery of the vibration region of the piezo-electric device 60 is full of a liquid.

FIG. 4(E) shows a sectional view of the piezo-electric device 60 when the liquid in the ink container is consumed, and no liquid exists in the periphery of the vibration region of the piezo-electric device 60, and a liquid remains in the cavity 43 of the piezo-electric device 60.

Formula 4 is a formula indicating a maximum inertance M'max decided from the density ρ of ink when the ink container is full of a liquid. On the other hand, the additional inertance M' when the liquid in the ink container is consumed, and a liquid remains in the cavity 43, and the liquid in the periphery of the vibration region of the piezo-electric device 60 is replaced with gas or a vacuum is generally expressed (more in detail, refer to Formula 8) as follows:

$$M'=\rho*t/S \quad \text{Formula 6}$$

where t indicates the thickness of the medium concerning vibration and S indicates an area of the vibration region of the piezo-electric device 60, which is $S=\pi*a^2$ when the vibration region is a circle with the radius "a".

Therefore, the additional inertance M', when the ink container is sufficiently filled with a liquid and the periphery of the vibration region of the piezo-electric device 60 is full of a liquid, follows Formula 4. On the other hand, the additional inertance M', when the liquid is consumed, and a liquid remains in the cavity 43, and the liquid in the periphery of the vibration region of the piezo-electric device 60 is replaced with gas or a vacuum, follows Formula 6.

Here, as shown in FIG. (E), the additional inertance M' when the liquid in the ink container is consumed, and no liquid exists in the periphery of the vibration region of the piezo-electric device 60, and a liquid remains in the cavity 43 of the piezo-electric device 60 is assumed as M'cav for convenience and distinguished from the additional inertance M'max when the periphery of the vibration region of the piezo-electric device 60 is full of a liquid.

FIG. 4(F) shows the equivalent circuit of the vibration part of the piezo-electric device 60 and the cavity 43 in FIG.

4(E) that the liquid in the ink container is consumed, and no liquid exists in the periphery of the vibration region of the piezo-electric device 60, and a liquid remains in the cavity 43 of the piezo-electric device 60.

In this case, the parameters relating to the medium state are the density ρ of the medium and the thickness t of the medium in Formula 6. When the ink container sufficiently contains a liquid, the liquid makes contact with the vibration part of the piezo-electric device 60. On the other hand, when the ink container does not contain a liquid sufficiently, a liquid remains in the cavity 43 or gas or a vacuum makes contact with the vibration part of the piezo-electric device 60. The additional inertance M'var in the process that the liquid in the periphery of the piezo-electric device 60 is consumed and the additional inertance is moved from M'max shown in FIG. 4(C) to M'cav shown in FIG. 4(E) is changed in correspondence with changing of the density ρ of the medium and the thickness t of the medium depending on the containing state of the liquid in the ink container. By doing this, the resonance frequency fs is also changed. Therefore, by identifying the resonance frequency fs, the amount of the liquid in the ink container can be detected.

Next, when t=d is assumed as shown in FIG. 4(E), M'cav is expressed as indicated below by substituting the cavity depth d for t given in Formula 6:

$$M'\text{cav}=\rho^{*}d/S \qquad \text{Formula 7}$$

Further, when the media are liquids different in the kind, the density ρ differs depending the difference in the composition, so that the additional inertance M' and resonance frequency fs are different. Therefore, by identifying the resonance frequency fs, the kind of liquid can be detected.

Figure 5A:
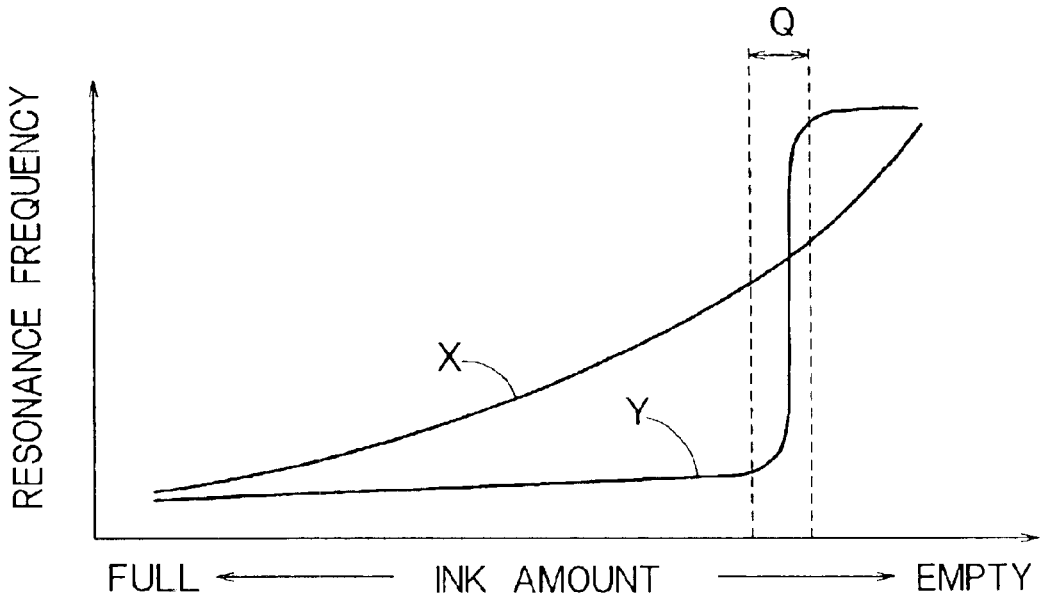
FIGS. 5A and 5B are drawings showing the relations between the resonance frequency of ink detected by the piezo-electric device shown in FIGS. 2 and 3 and the ink density.

FIG. 5A is a graph showing the relation between the ink amount in the ink tank and the resonance frequency fs of ink and the vibration part. Here, as an example of a liquid, ink will be explained. The ordinate axis indicates the resonance frequency fs and the transverse axis indicates the ink amount. When the ink composition is fixed, as the ink residue reduces, the resonance frequency fs increases.

When the ink container sufficiently contains ink and the periphery of the vibration part of the piezo-electric device 60 is full of ink, the maximum additional inertance M'max thereof is a value expressed by Formula 4. On the other hand, when the ink is consumed, and ink remains in the cavity 43, and the periphery of the vibration region of the piezo-electric device 60 is not full of ink, the additional inertance M'var is calculated from Formula 6 on the basis of the thickness t of the medium. "t" in Formula 6 is the thickness of the medium concerning vibration, so that by making the depth d of the cavity 43 of the piezo-electric device 60 where ink remains smaller, that is, making the thickness of the substrate 41 sufficiently thinner, the process that ink is slowly consumed can be detected (refer to FIG. 4(C)). In this case, t ink indicates the ink thickness concerning vibration and t ink-max indicates t ink at M' max.

For example, the piezo-electric device 60 is arranged on the bottom of the ink cartridge almost horizontally to the ink level. In this case, when the ink is consumed and the ink level lowers less than the height of t ink-max from the piezo-electric device 60, M'var is slowly changed by Formula 6 and the resonance frequency fs is slowly changed by Formula 1. Therefore, as long as the ink level is within the t range, the piezo-electric device 60 can detect slowly the consumption state of ink.

Or, on the side wall of the ink cartridge, the piezo-electric device 60 is arranged almost perpendicularly to the ink level. In this case, when the ink is consumed and the ink level reaches the vibration region of the piezo-electric device 60, as the water level lowers, the additional inertance M' is reduced. By doing this, the resonance frequency fs is slowly increased by Formula 1. Therefore, as long as the ink level is within the range of the diameter 2*a* (refer to FIG. 4(C)) of the cavity 43, the piezo-electric device 60 can slowly detect the consumption state of ink.

The curve X shows the relation between the ink amount contained in the ink tank and the resonance frequency fs of ink and the vibration part when the cavity 43 of the piezo-electric device 60 arranged on the bottom is made sufficiently shallow or the vibration region of the piezo-electric device 60 arranged on the side wall is made sufficiently large or long. The situation that as the ink amount in the ink tank reduces, the resonance frequency fs of ink and the vibration part is slowly changed can be understood.

More in detail, a case that the process that ink is slowly consumed can be detected is a case that in the periphery of the vibration region of the piezo-electric device 60, a liquid and gas which are different indensity coexist and are concerned vibration. As ink is slowly consumed, in the periphery of the vibration region of the piezo-electric device 60, with respect to the media concerning vibration, the liquid is reduced, while gas is increased.

For example, when the piezo-electric device 60 is arranged horizontally to the ink level and t ink is smaller than t ink-max, the media concerning vibration of the piezo-electric device 60 include both ink and gas. Therefore, when a state lower than M'max in Formula 4 is expressed by the additional weight of ink and gas using the area S of the vibration region of the piezo-electric device 60, the following formula is obtained:

$$M'=M'\text{air}+M'\text{ink}=\rho\text{air}^{*}t\ \text{air}/S+\rho\text{ink}^{*}t\ \text{ink}/S \qquad \text{Formula 8}$$

where M'air the indicates inertance of air, M'ink the inertance of ink, ρair the density of air, ρink the density of ink, t air the thickness of air concerning vibration, and t ink the thickness of ink concerning vibration.

Among the media concerning vibration in the periphery of the vibration region of the piezo-electric device 60, when as a liquid reduces and gas increases, the piezo-electric device 60 is arranged almost horizontally to the ink level, t air increases and t ink reduces. By doing this, M'var slowly reduces and the resonance frequency slowly increases. Therefore, the ink amount remaining in the ink tank or the ink consumption can be detected. Further, the reason that Formula 7 is a formula of only the liquid density is that a case that the air density is so smaller than the liquid density as to be ignored is supposed.

When the piezo-electric device 60 is arranged almost perpendicularly to the ink level, among the vibration region of the piezo-electric device 60, parallel equivalent circuits (not shown in the drawing) of the region that the medium concerning vibration of the piezo-electric device 60 is only ink and the region that the medium concerning vibration of the piezo-electric device 60 is only gas are considered. Assuming the area of the region that the medium concerning vibration of the piezo-electric device 60 is only ink as S ink and the area of the region that the medium concerning vibration of the piezo-electric device 60 is only gas as S air, the following formula is obtained.

$$1/M'=1/M'\text{air}+1/M'\text{ink}=S\ \text{air}/(\rho\text{air}^{*}t\ \text{air})+S\ \text{ink}/(\rho\text{ink}^{*}t\ \text{ink}) \qquad \text{Formula 9}$$

Further, Formula 9 is applied to a case that no ink is held in the cavity 43 of the piezo-electric device 60. The additional inertance when ink is held in the cavity 43 of the piezo-electric device 60 can be calculated by the sum of M' in Formula 9 and M'cav in Formula 7.

The vibration of the piezo-electric device 60 is changed from the depth t ink-max to the ink remaining depth d, so that when the piezo-electric device 60 is arranged on the bottom in a state that the ink remaining depth is slightly smaller than t ink-max, the process that ink is slowly reduced cannot be detected. In this case, from vibration changes of the piezo-electric device for slight changes in the ink amount from t ink-max to the remaining depth d, changing of the ink amount is detected. Further, when the piezo-electric device 60 is arranged on the side and the diameter of the cavity 43 is small, vibration changes of the piezo-electric device 60 during passing the cavity 43 are minute, so that it is difficult to detect the ink amount in the passing process and whether the ink level is above or below the cavity 43 is detected.

For example, the curve Y in FIG. 5A shows the relation between the ink amount in the ink tank and the resonance frequency fs of ink and the vibration part when the vibration region is a small circular region. The situation is shown that in the section of the difference Q in the ink amount before and after the ink level in the ink tank passes the mounting position of the piezo-electric device 60, the resonance frequency fs of ink and the vibration part is changed violently. From this, whether a predetermined amount of ink remains in the ink tank or not can be detected on a binary basis.

A method for detecting existence of a liquid using the piezo-electric device 60 detects existence of ink from direct contact of the diaphragm 42 with a liquid, so that the detection accuracy is higher than that of a method for calculating the ink consumption by the software. Further, a method for detecting existence of ink by the conductivity using an electrode is affected by the mounting position of the electrode on the ink container and the ink kind, while the method for detecting existence of a liquid using the piezo-electric device 60 is hardly affected by the mounting position of the piezo-electric device 60 on the ink container and the ink kind.

Furthermore, both vibration and detection of existence of a liquid can be executed using a single piezo-electric device 60, so that as compared with a method for executing vibration and detection of existence of a liquid using different sensors, the number of sensors to be mounted on the ink container can be reduced. Further, it is preferable to set the vibration frequency of the piezo-electric layer 47 in the non-audible range, thereby abate noise generated during operation of the piezo-electric device 60.

Figure 5B:
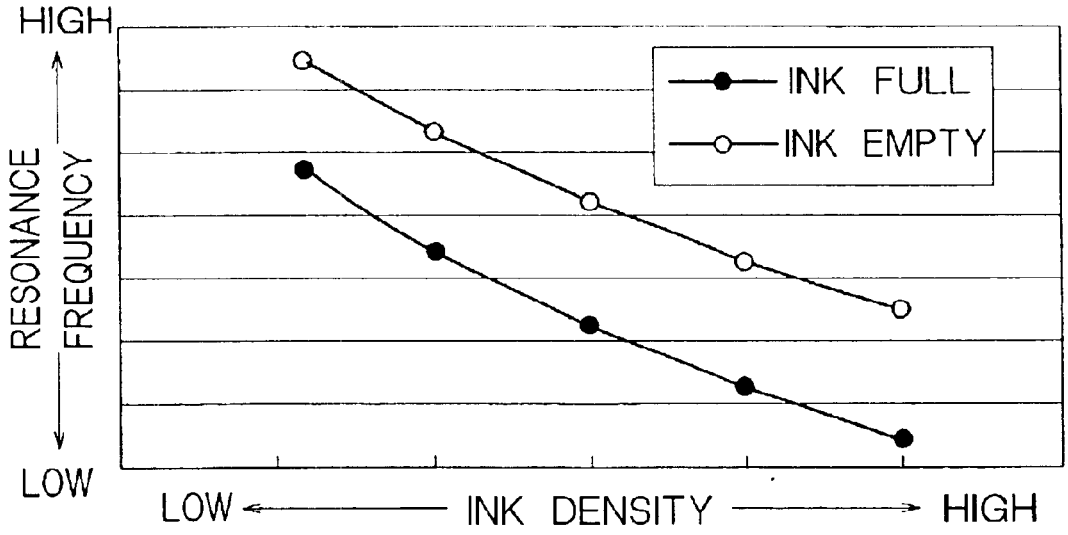

FIG. 5B shows an example of the relation between the ink density and the resonance frequency fs of ink and the vibration part. "Ink filled" and "Ink empty" (or "No ink") mean two relative states and do not mean the so-called "ink full state" and "ink end state". As shown in FIG. 5B, when the ink density is high, the additional inertance increases, so that the resonance frequency fs lowers. Namely, the resonance frequency fs varies with the ink kind. Therefore, when the resonance frequency fs is measured, thus ink is to be refilled, mixture of ink with different density can be confirmed. Namely, ink tanks containing different kinds of ink can be discriminated.

Next, when the size and shape of the cavity 43 are set so that a liquid remains in the cavity 43 of the piezo-electric device 60 even if the ink container is in an empty ink state, the condition for accurately detecting the liquid state will be described in detail. If the piezo-electric device 60 can detect the liquid state when the cavity 43 is full of a liquid, even when the cavity 43 is not full of a liquid, the piezo-electric device 60 can detect the liquid state.

The resonance frequency fs is a function of the inertance M. The inertance M is the sum of the inertance Mact of the vibration part and the additional inertance M'. In this case, the inertance M' is related to the liquid state. The inertance M' is an amount indicating that the weight of the vibration part is apparently increased by the media existing in the neighborhood of the vibration part. Namely, it is an increase in the weight of the vibration part by apparently absorbing (the inertance concerning vibration increases) the medium by the vibration of the vibration part.

Therefore, when M'cav is larger than M'max in Formula 4, the media apparently absorbed are all a liquid remaining in the cavity 43. Therefore, this is the same as the state that the ink container is full of a liquid. In this case, the medium concerning vibration is not smaller than M'max, so that even if ink is consumed, no changes can be detected.

On the other hand, when M'cav is smaller than M'max in Formula 4, the media apparently absorbed are a liquid remaining in the cavity 43 and gas or a vacuum in the ink container. At this time, unlike the state that the ink container is full of a liquid, M' is changed, so that the resonance frequency fs is changed. Therefore, the piezo-electric device 60 can detect the liquid state in the ink container.

Namely, when the ink container is in an empty liquid state and a liquid remains in the cavity 43 of the piezo-electric device 60, the condition for accurately detecting the liquid state by the piezo-electric device 60 is that M'cav is smaller than M'max. Further, the condition M'max>M'cav for accurately detecting the liquid state by the piezo-electric device 60 is not related to the shape of the cavity 43.

In this case, M'cav indicates weight inertance of a liquid with the almost same volume as that of the cavity 43. Therefore, from an inequality of M'max>M'cav, the condition for accurately detecting the liquid state by the piezo-electric device 60 can be expressed as a condition of the volume of the cavity 43. For example, assuming the radius of the circular cavity 43 as "a" and the depth of the cavity 43 as d, the following inequality is held.

$$M'\text{max} > \rho * d/\pi a^2 \qquad \text{Formula 10}$$

When Formula 10 is expanded, the following condition is obtained.

$$a/d > 3 * \pi/8 \qquad \text{Formula 11}$$

Therefore, the piezo-electric device 60 that the radius of the opening 161 satisfying Formula 11 is "a" and the depth of the cavity 43 is d, even if the ink container is in an empty liquid state and a liquid remains in the cavity 43, can detect the liquid state free of malfunctions.

Further, Formulas 10 and 11 are held only when the shape of the cavity 43 is a circle. When the shape of the cavity 43 is not a circle, using the formula of the corresponding M'max, Formula 10 is calculated by replacing $\pi a^2$ with the area thereof, the relation between the dimensions of the cavity 43 such as width and length and the depth can be derived.

Further, the additional inertance M' also affects the acoustic impedance characteristic, so that it may be said that the method for measuring the counter electromotive force generated in the piezo-electric device 60 by the residual vibration detects at least changes in the acoustic impedance.

Figure 6A:
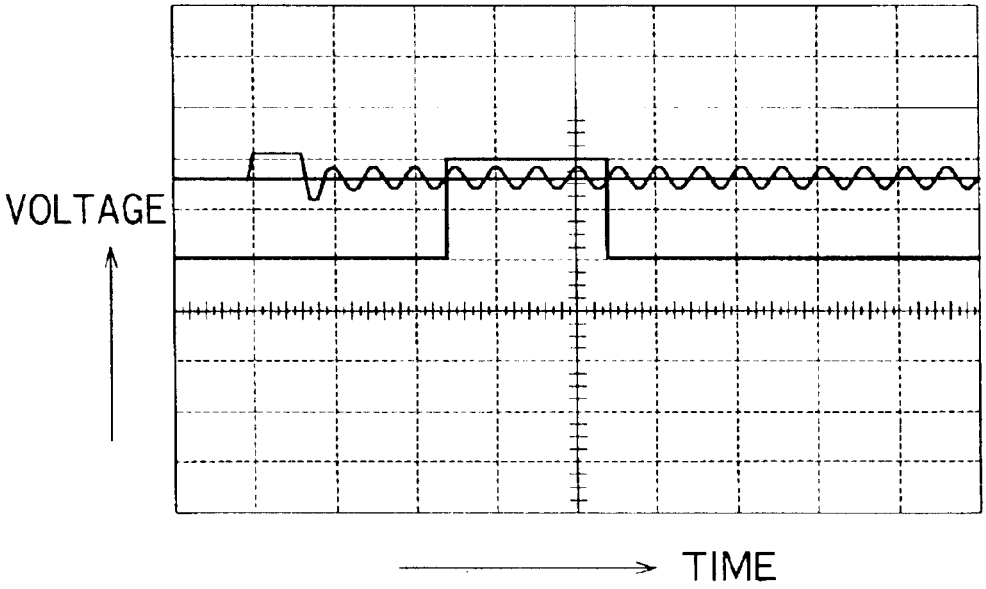
FIGS. 6A and 6B are drawings showing the waveforms of counter electromotive force of the piezo-electric device shown in FIGS. 2 and 3.
Figure 6B:
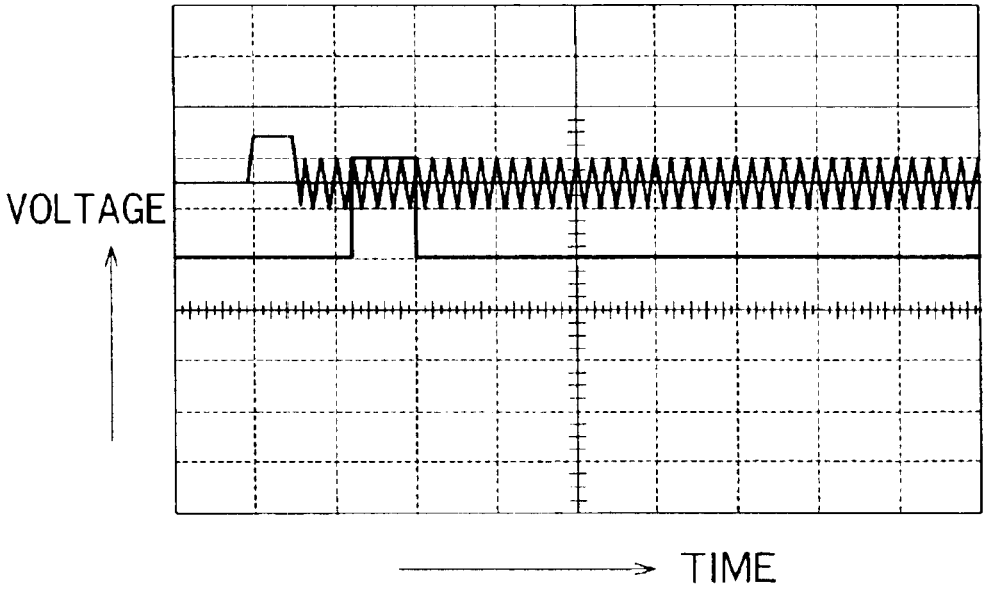

FIGS. 6A and 6B show a measuring method for the waveform of residual vibration of the piezo-electric device 60 and the residual vibration after supplying a drive signal to the piezo-electric device 60 and vibrating the vibration part. The ink level above or below the mounting position level of the piezo-electric device 60 in the ink cartridge can be detected by changes in the frequency of the residual vibration after vibration of the piezo-electric device 60 or changes in the amplitude. In FIGS. 6A and 6B, the ordinate axis indicates the voltage of the counter electromotive force generated by the residual vibration of the piezo-electric device 60 and the transverse axis indicates the time. By the residual vibration of the piezo-electric device 60, as shown in FIGS. 6A and 6B, the waveform of an analog signal of the voltage is generated. Next, the analog signal is converted (binarized) to a digital numerical value. In the examples shown in FIGS. 6A and 6B, the time required for generating 4 pulses from the 4th pulse to the 8th pulse is measured.

More in detail, after vibration of the piezo-electric device 60, the number of times of crossing a predetermined reference voltage, which is preset, from the low voltage side to the high voltage side is counted. And, a digital signal that the interval between the count 4 and the count 8 is high is generated and the time from the count 4 to the count 8 is measured by a predetermined clock pulse.

FIG. 6A shows the waveform when the ink level is above the mounting position level of the piezo-electric device 60. On the other hand, FIG. 6B shows the waveform when there is no ink on the mounting position level of the piezo-electric device 60. The comparison of FIG. 6A with FIG. 6B shows that the time from the count 4 to the count 8 shown in FIG. 6A is longer than that shown in FIG. 6B. In other words, the required time from the count 4 to the count 8 varies with existence of ink. By use of the difference in the required time, the ink consumption state can be detected.

The reason that the number of times is counted from the 4th count of the analog waveform is that the measurement is started after the vibration of the piezo-electric device 60 is stabilized. Starting from the 4th count is just an example and the number of times may be counted from an optional count. Here, the signal from the 4th count to the 8th count is detected and the time from the 4th count to the 8th count is measured by a predetermined clock pulse. On the basis of this time, the resonance frequency can be obtained. For the clock pulse, there is no need to measure the time up to the 8th count and the number of times may be counted up to an optional count. In FIGS. 6A and 6B, the time from the 4th count to the 8th count is measured. However, according to the circuit constitution for detecting the frequency, the time within a different count interval may be detected.

For example, when the quality of ink is stable and the peak amplitude varies little, to speed up the detection, the resonance frequency may be obtained by detecting the time from the 4th count to the 6th count. Further, when the quality of ink is unstable and the pulse amplitude varies large, to accurately detect the residual vibration, the time from the 4th count to the 12th count may be detected.

Figure 7:
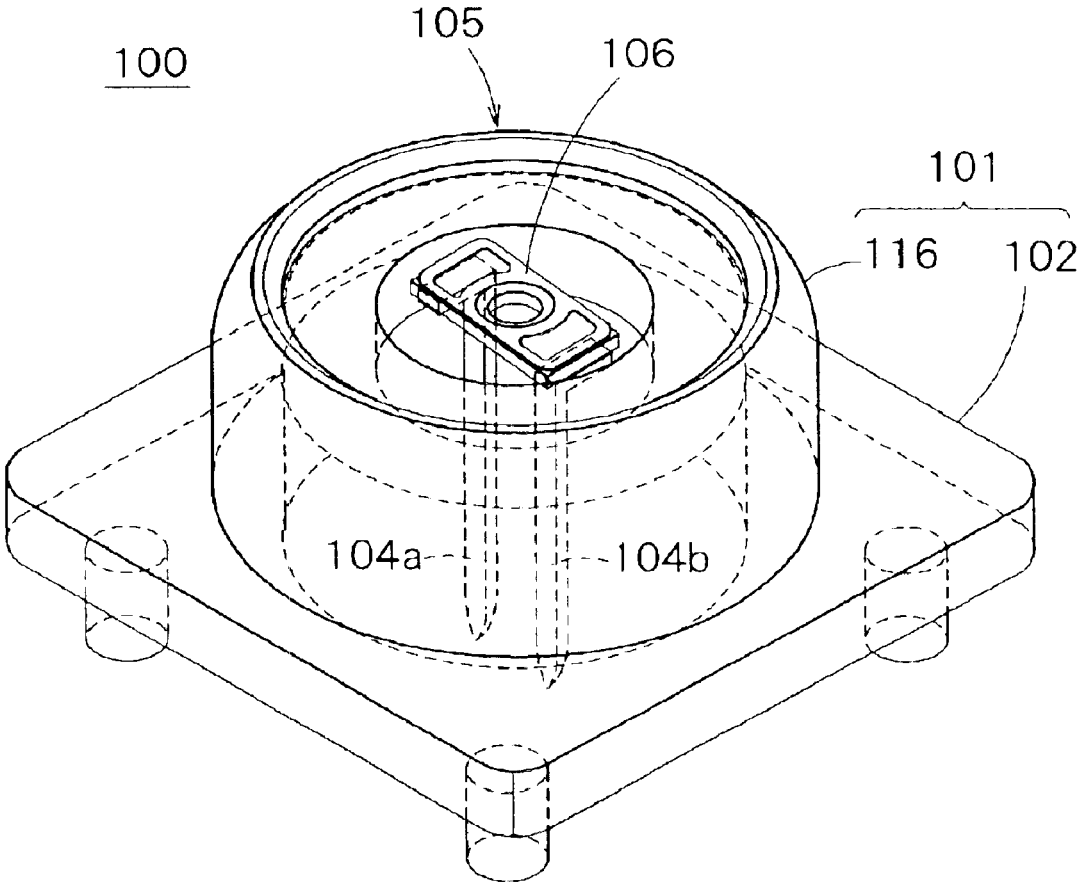
FIG. 7 is a perspective view showing a module body incorporating the piezo-electric device shown in FIGS. 2 and 3.

FIG. 7 is a perspective view showing the constitution of the piezo-electric device 60 integratedly formed as a mounting module body 100. The module body 100 is mounted at a predetermined location of the ink container of the ink cartridge. The module body 100 is structured so as to detect the liquid consumption state in the ink container by detecting at least changes in the acoustic impedance of the medium in the ink container.

The module body 100 in this embodiment has an ink container mounting unit 101 for mounting the piezo-electric device 60 to the ink container. The ink container mounting unit 101 has a base pedestal 102 having an almost rectangular surface and a column 116 for storing the piezo-electric device 60 vibrating by a drive signal which is installed on the base pedestal 102. Further, the module body 100 is structured so that when it is mounted on the ink cartridge, the piezo-electric device 60 of the module body 100 cannot be touched from the outside. By doing this, the piezo-electric device 60 can be protected from external contact. Further, the end edge of the column 116 is rounded and easily fit when it is to be mounted into the hole formed in the ink cartridge.

Figure 8:
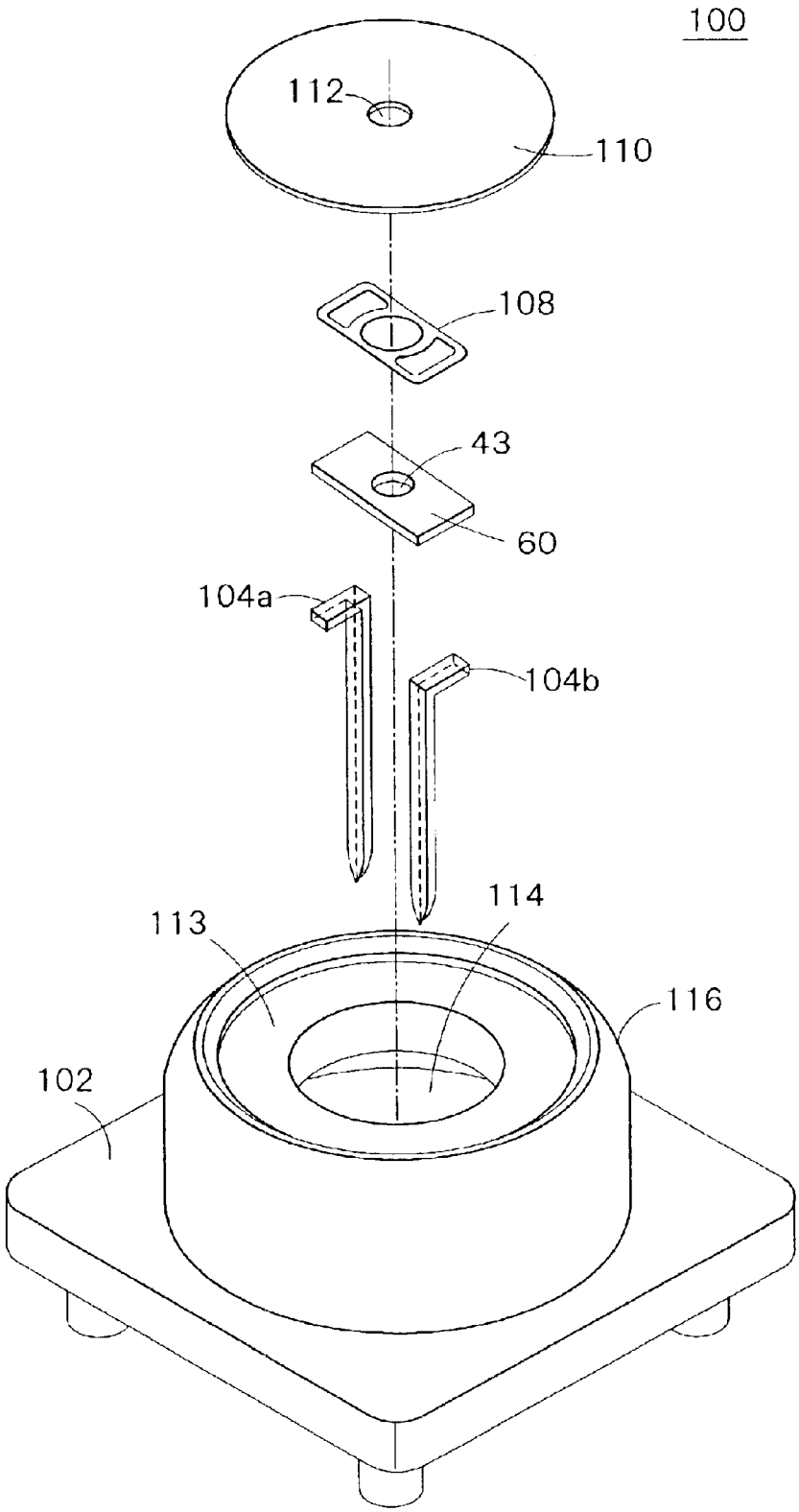
FIG. 8 is an exploded view showing the constitution of the module body shown in FIG. 7.

FIG. 8 is an exploded view of the module body 100 shown in FIG. 7. The module body 100 includes the ink container mounting unit 101 made of resin, a plate 110, and a piezo-electric device mounting unit 105 (refer to FIG. 7) having a concavity 113. Furthermore, the module body 100 has lead wires 104*a* and 104*b*, the piezo-electric device 60, and a film 108. The plate 110 is preferably formed from a rust proof material such as stainless steel or stainless steel alloy.

The column 116 and the base pedestal 102 included in the ink container mounting unit 101 have an opening 114 formed at the center so as to store the lead wired 104*a* and 104*b* and the concavity 113 is formed around the opening 114 so as to store the piezo-electric device 60, the film 108, and the plate 110.

The piezo-electric device 60 is joined to the plate 110 via the film 108 and the plate 110 and the piezo-electric device 60 are fixed to the concavity 113 (the ink container mounting unit 101). Therefore, the lead wires 104*a* and 104*b*, the piezo-electric device 60, the film 108, and the plate 110 are integratedly mounted to the ink container mounting unit 101.

The lead wires 104*a* and 104*b* are respectively joined to the upper electrode terminal 45 and the lower electrode terminal 44 of the piezo-electric device 60, transfer a driving signal to the piezo-electric layer 47, and transfer a signal with the resonance frequency detected by the piezo-electric device 60 to the recorder.

The piezo-electric device 60 vibrates temporarily on the basis of the driving signal transferred from the lead wires 104*a* and 104*b*. Further, the piezo-electric device 60 vibrates residually and the vibration generates counter electromotive force. At this time, the vibration period of the waveform of counter electromotive force is detected, thus the resonance frequency corresponding to the consumption state of liquid in the ink container can be detected.

The film 108 bonds the piezo-electric device 60 and the plate 110 and makes the piezo-electric device 60 air-tight. The film 108 is preferably made of polyolefin and bonded by thermal fusion. When the piezo-electric device 60 and the plate 110 are bonded and fixed flatwise by the film 108, there are no variations with the bonding place and the parts other than the vibration part do not vibrate. Therefore, even if the piezo-electric device 60 is bonded to the plate 110, the vibration characteristic of the piezo-electric device 60 is not changed.

Further, the plate 110 is circular and the opening 114 of the base pedestal 102 is cylindrical. The piezo-electric device 60 and the film 108 are rectangular. The lead wires 104*a* and 104*b*, the piezo-electric device 60, the film 108, and the plate 110 may be connected to the base pedestal in a removal state. The base pedestal 102, the lead wires 104*a* and 104*b*, the piezo-electric device 60, the film 108, and the plate 110 are arranged symmetrically with respect to the central axis of the module body 100. Further, the centers of the base pedestal 102, the piezo-electric device 60, the film 108, and the plate 110 are arranged almost on the central axis of the module body 100.

Further, the area of the opening 114 of the base pedestal 102 is larger than the area of the vibration region of the piezo-electric device 60. In the position faced with the vibration part of the piezo-electric device 60 at the center of the plate 110, a through hole 112 is formed. As shown in FIGS. 2 to 4, the cavity 43 is formed in the piezo-electric device 60 and the through hole 112 and the cavity 43 respectively form an ink reservoir. The thickness of the plate 110 is preferably smaller than the diameter of the through hole 112 so as to decrease the effect of the residual ink. For example, the depth of the through hole 112 is preferably less than ⅓ of the diameter thereof. The through hole 112 has an almost round shape symmetrical with respect to the central axis of the module body 100. Further, the area of the through hole 112 is larger than the opening area of the cavity 43 of the piezo-electric device 60. The periphery of the section of the through hole 112 may be tapered or stepped.

The module body 100 is mounted on the side, top, or bottom of the ink container so as to direct the through hole 112 inward the ink container. When ink is consumed and ink around the piezo-electric device 60 is exhausted, based on large changes in the resonance frequency of the piezo-electric device 60, changes in the ink level can be detected.

Figure 9:
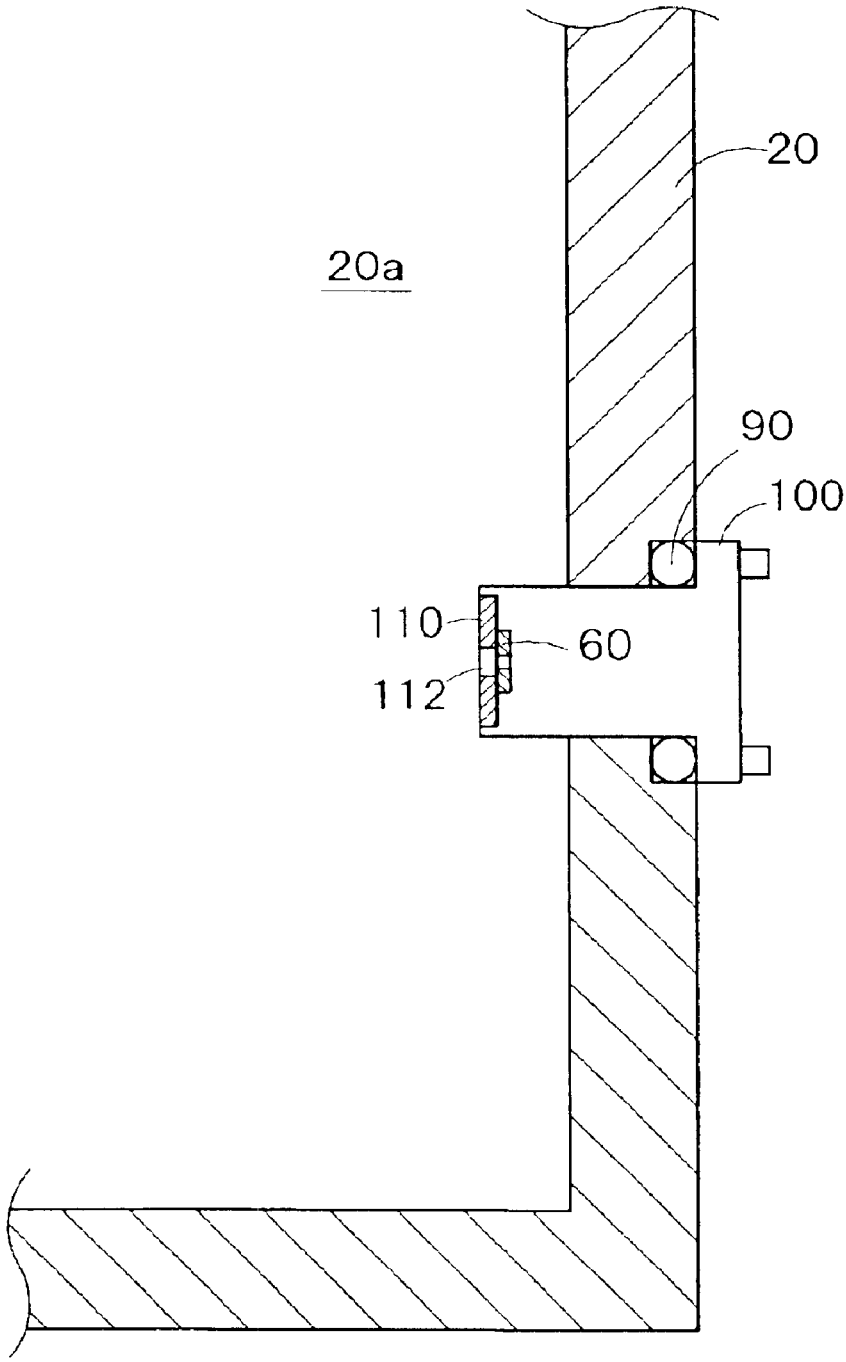
FIG. 9 is a drawing showing an example of the section of the module body shown in FIG. 7 which is mounted in an ink container of an ink cartridge.

FIG. 9 is a sectional view of the neighborhood of the bottom of an ink container 20 when the module body 100 shown in FIG. 7 is mounted in the ink container 20 of the ink cartridge 7. The module body 100 is mounted in the through hole formed in the side wall of the ink container 20. On the junction surface between the side wall of the ink container 20 and the module body 100, an O-ring 90 is installed so as to keep the module body 100 and the ink container 20 air-tight. Since the junction surface is sealed by the O-ring like this, the module body 100 preferably has a column as explained in FIG. 7.

Since the end of the module body 100 is exposed in an ink containing space 20*a* of the ink container 20, ink in the ink container 20 makes contact with the piezo-electric device 60 via the through hole 112 of the plate 110. The resonance frequency of the residual vibration of the piezo-electric device 60 varies with whether the medium around the vibration part of the piezo-electric device 60 is a liquid or gas, so that the ink consumption state can be detected using the module body 100.

Figure 10:
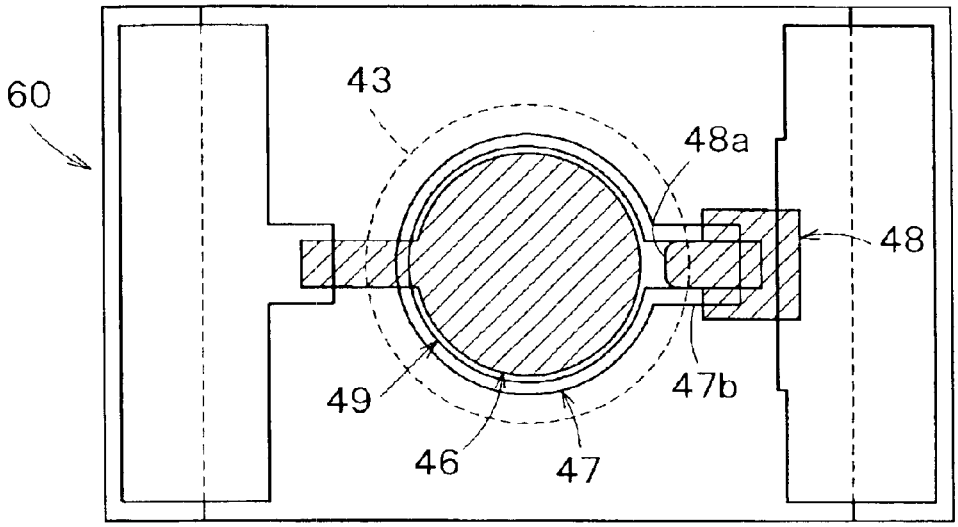
FIG. 10 is a drawing showing a piezo-electric device of a varied example of the embodiment shown in FIGS. 2 and 3.

Next, as a varied example of the embodiment shown in FIGS. 2 and 3, as shown in FIG. 10, the projection 48*a* of the auxiliary electrode layer 48 may be formed narrower than the extension part 47*b* of the piezo-electric layer 47.

By doing this, the area of the auxiliary electrode layer 48 overlaid on the region corresponding to the cavity 43 is made smaller, so that the vibration characteristic of the piezo-electric device 60 can be improved. Further, the necessary amount of the material for forming the auxiliary electrode layer 48 can be decreased, so that the manufacturing cost can be reduced.

Figure 11:
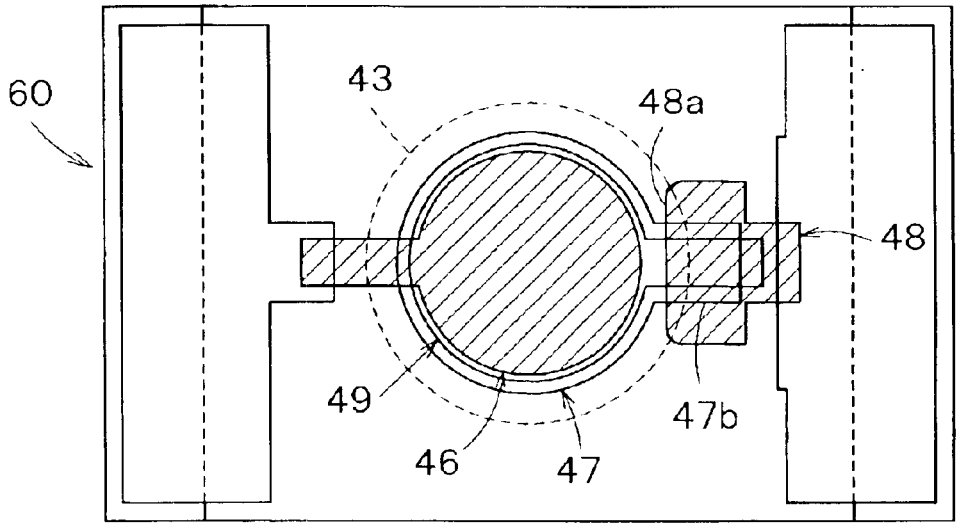
FIG. 11 is a drawing showing a piezo-electric device of another varied example of the embodiment shown in FIGS. 2 and 3.

Further, as another varied example, as shown in FIG. 11, the projection 48*a* of the auxiliary electrode layer 48 can be formed wider than the extension part 47*b* of the piezo-electric layer 47. By doing this, the periphery of the cavity 43 can be reinforced.

Figure 12:
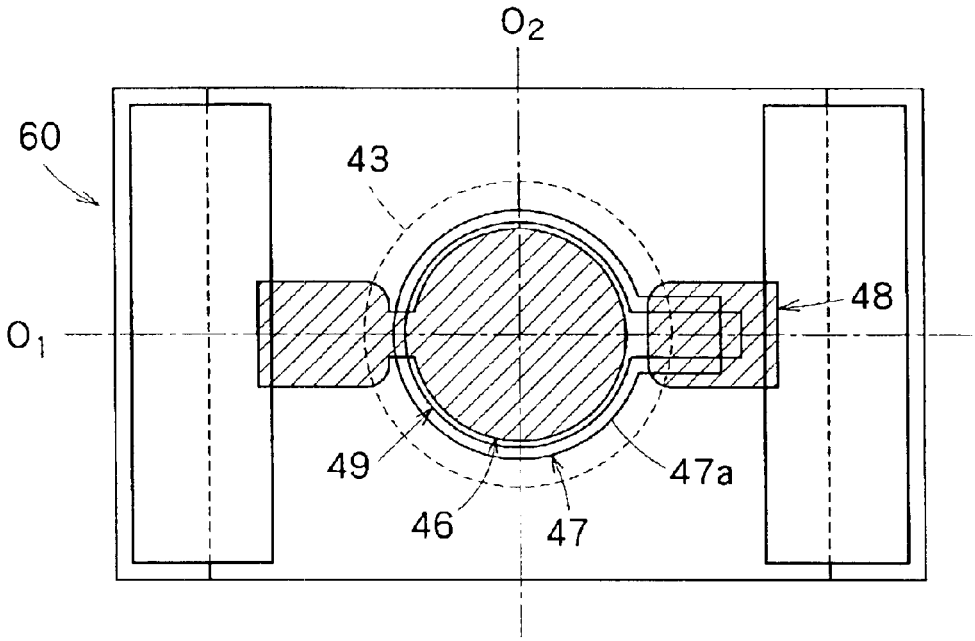
FIG. 12 is a drawing showing a piezo-electric device of still another varied example of the embodiment shown in FIGS. 2 and 3.
Figure 13:
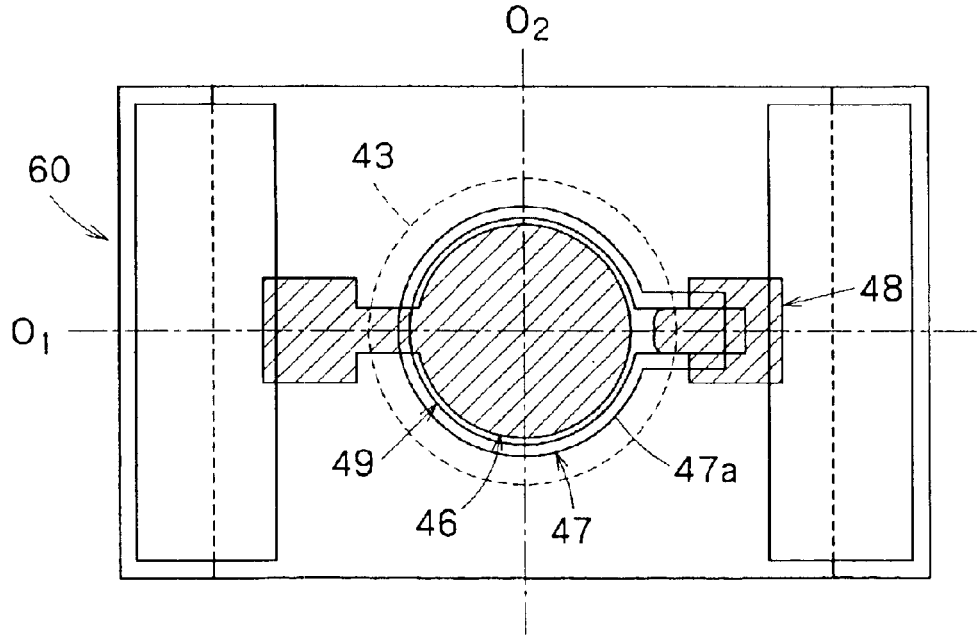
FIG. 13 is a drawing showing a piezo-electric device of a further varied example of the embodiment shown in FIGS. 2 and 3.
Figure 14:
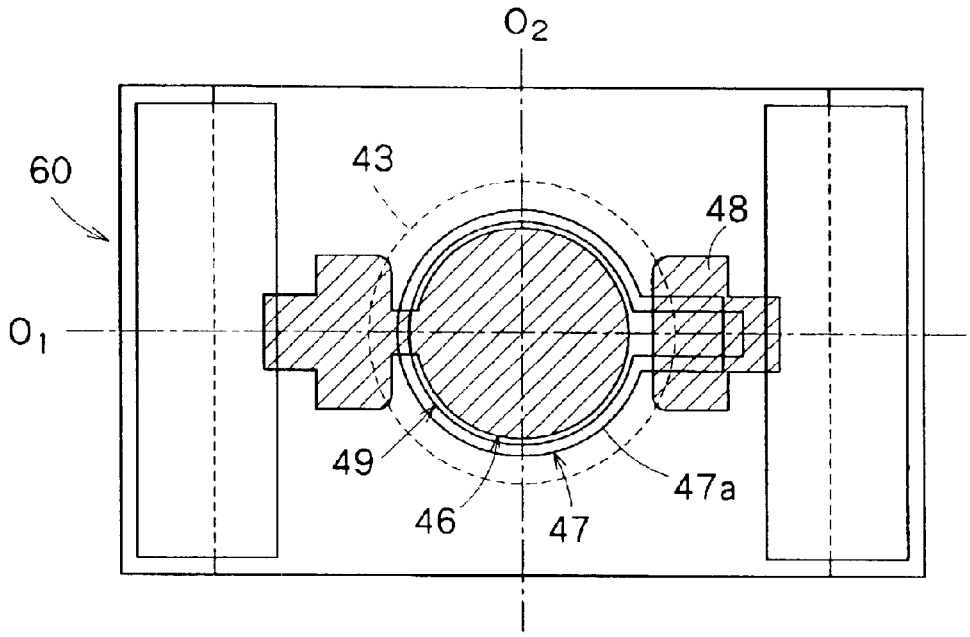
FIG. 14 is a drawing showing a piezo-electric device of a still further varied example of the embodiment shown in FIGS. 2 and 3.

Furthermore, as still another varied example, as shown in FIGS. 12 to 14, the lower electrode layer 46, the upper electrode layer 49, and the auxiliary electrode layer 48, as a whole, can be formed in an almost symmetrical shape having the symmetrical axes $O_1$ and $O_2$ passing through the center of the body 47*a* of the piezo-electric layer 47. When a plurality of members constituting the piezo-electric device 60 are arranged in a symmetrical shape as a whole like this, the vibration characteristic of the piezo-electric device 60 can be improved. Especially, when the lower electrode layer 46, the upper electrode layer 49, and the auxiliary electrode layer 48 positioned in the region corresponding to the cavity 43 are made symmetric as a whole, the vibration characteristic of the piezo-electric device 60 is improved.

Next, the piezo-electric device of another embodiment of the present invention will be explained by referring to FIG. 15. Further, the parts different from the aforementioned embodiment shown in FIGS. 2 and 3 will be explained hereunder.

Figure 15:
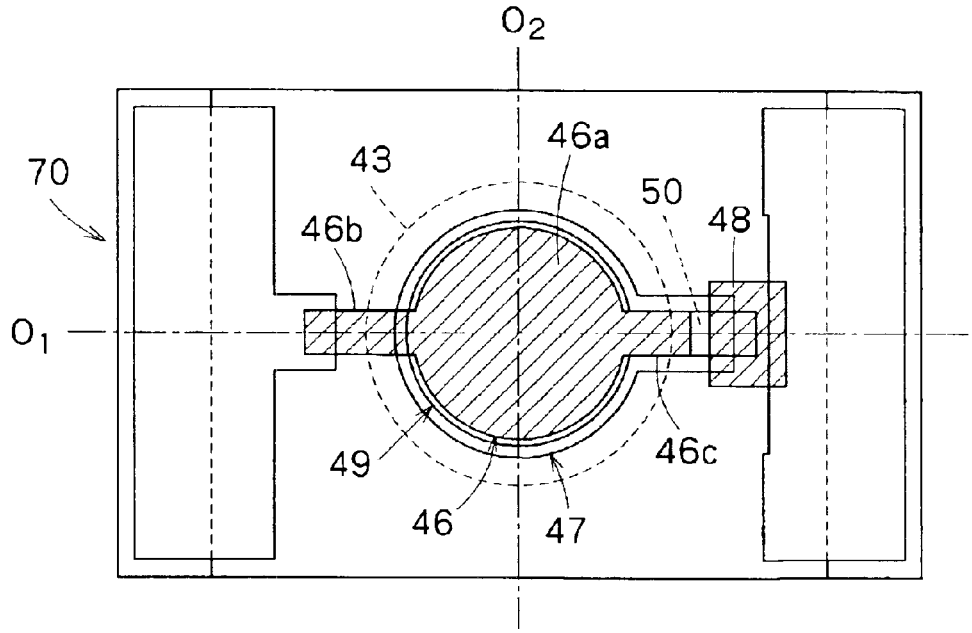
FIG. 15 is a drawing showing a piezo-electric device of another embodiment of the present invention.

As shown in FIG. 15, in a piezo-electric device 70 of this embodiment, the lower electrode layer 46 has an extension part 46*c* extending toward the auxiliary electrode layer 48 from the circular body 46*a* positioned in the region corresponding to the cavity 43 beyond the position corresponding to the periphery 43*a* of the cavity 43. On the other hand, the whole auxiliary electrode layer 48 is formed outside the region corresponding to the cavity 43. And, the insulating gap 50 is formed between the extension part 46*c* of the lower electrode layer 46 and the auxiliary electrode layer 48 and the whole insulating gap 50 is positioned outside the region corresponding to the cavity 43.

When the whole insulating gap 50 is positioned outside the region corresponding to the cavity 43 like this and the vibration part of the piezo-electric device 70 is vibrated by driving the piezo-electric device 70, stress concentration generated in the piezo-electric layer 47 at the position corresponding to the periphery 43*a* of the cavity 43 can be greatly suppressed. Therefore, a generation of cracks in the piezo-electric layer 47 and the upper electrode layer can be prevented.

Figure 16:
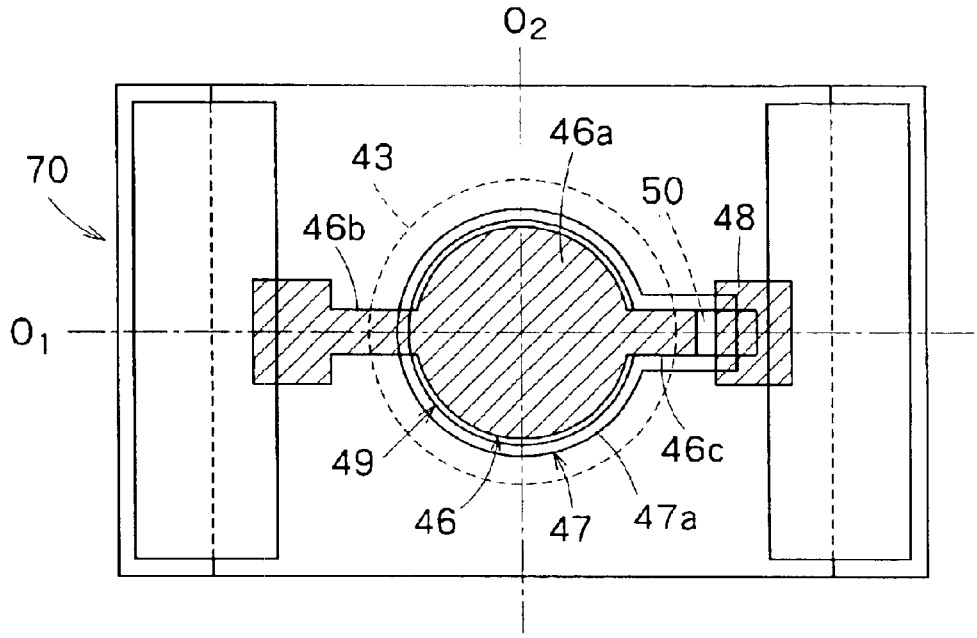
FIG. 16 is a drawing showing a piezo-electric device of a varied example of the embodiment shown in FIG. 15.

As a varied example of the embodiment shown in FIG. 15, as shown in FIG. 16, the lower electrode layer 46, the upper electrode layer 49, and the auxiliary electrode layer 48, as a whole, can be formed in an almost symmetrical shape having the symmetrical axes $O_1$ and $O_2$ passing through the center of the body 47*a* of the piezo-electric layer 47. When a plurality of members constituting the piezo-electric device 70 are arranged in a symmetrical shape as a whole like this, the vibration characteristic of the piezo-electric device 70 can be improved. Especially, when the lower electrode layer 46, the upper electrode layer 49, and the auxiliary electrode layer 48 positioned in the region corresponding to the cavity 43 are made symmetric as a whole, the vibration characteristic of the piezo-electric device 70 is improved.

Particularly, in the varied example, the insulating gap 50 is positioned outside the region corresponding to the cavity 43, so that the symmetry of the lower electrode layer 46, the upper electrode layer 49, and the auxiliary electrode layer 48 as a whole is enhanced and the vibration characteristic can be more improved as well.

Next, as another embodiment of the present invention, in the aforementioned respective embodiments and varied examples, the piezo-electric layer 47 positioned in the region corresponding to the cavity 43 can be formed in an almost symmetrical shape having at least one axis of symmetry passing the center of the body 47*a* of the piezo-electric layer 47. More preferably, the piezo-electric layer 47 positioned in the region corresponding to the cavity 43 is formed in an almost symmetrical shape having the first axis of symmetry $O_1$ extending in the extension direction of the extension part 47*b* of the piezo-electric layer 47 and the second axis of symmetry $O_2$ orthogonal to the first axis of symmetry $O_1$.

Figure 17:
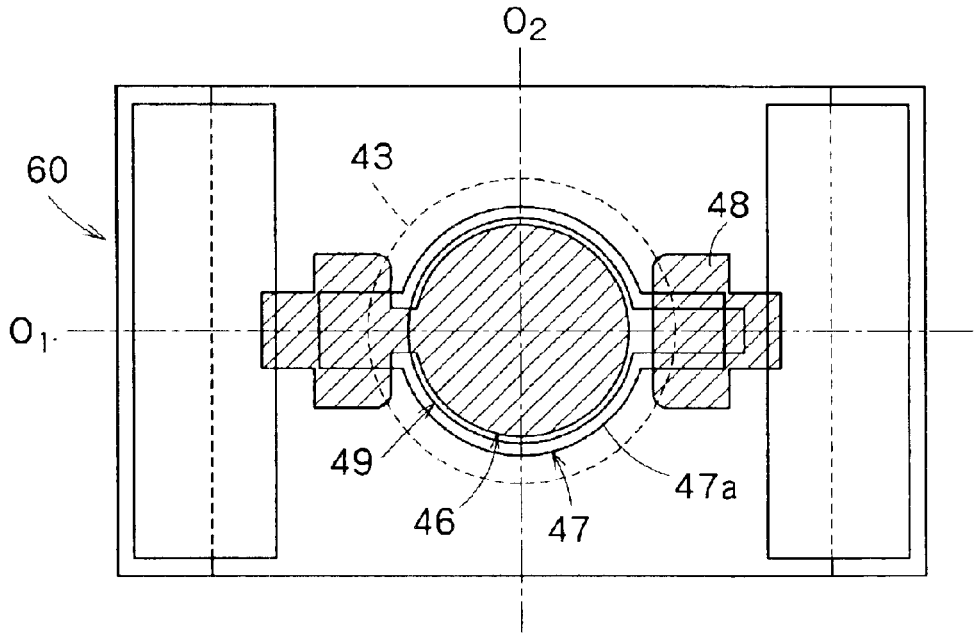
FIG. 17 is a drawing showing a suitable example of a piezo-electric device of another embodiment of the present invention.
Figure 18:
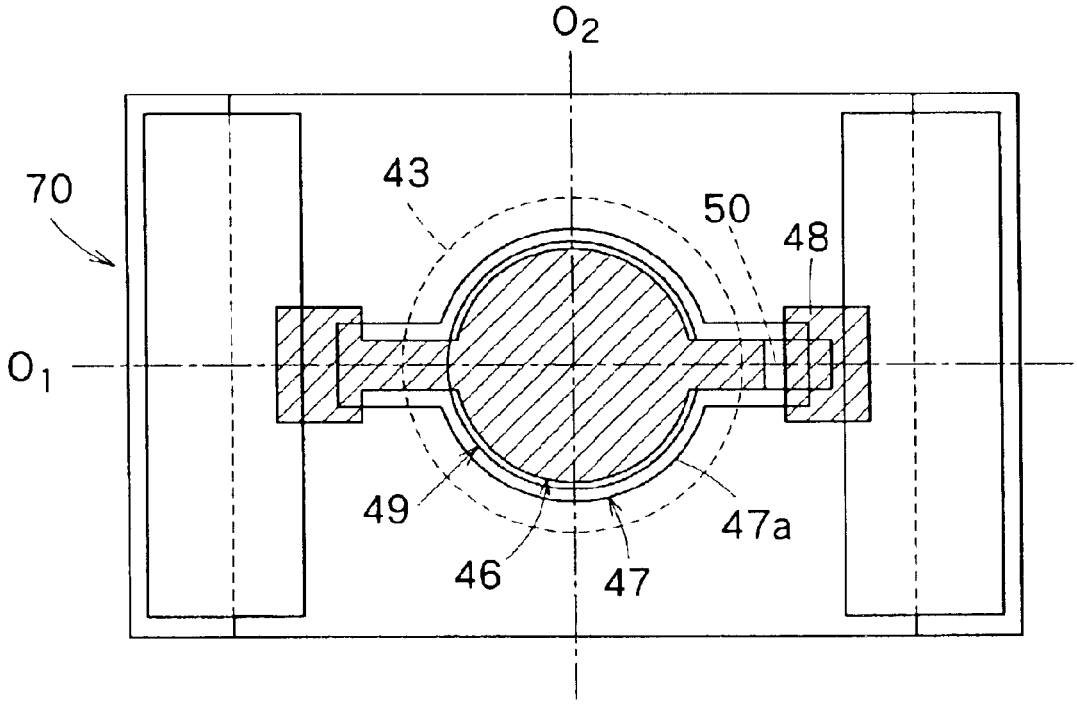
FIG. 18 is a drawing showing another suitable example of a piezo-electric device of another embodiment of the present invention.
Figure 19:
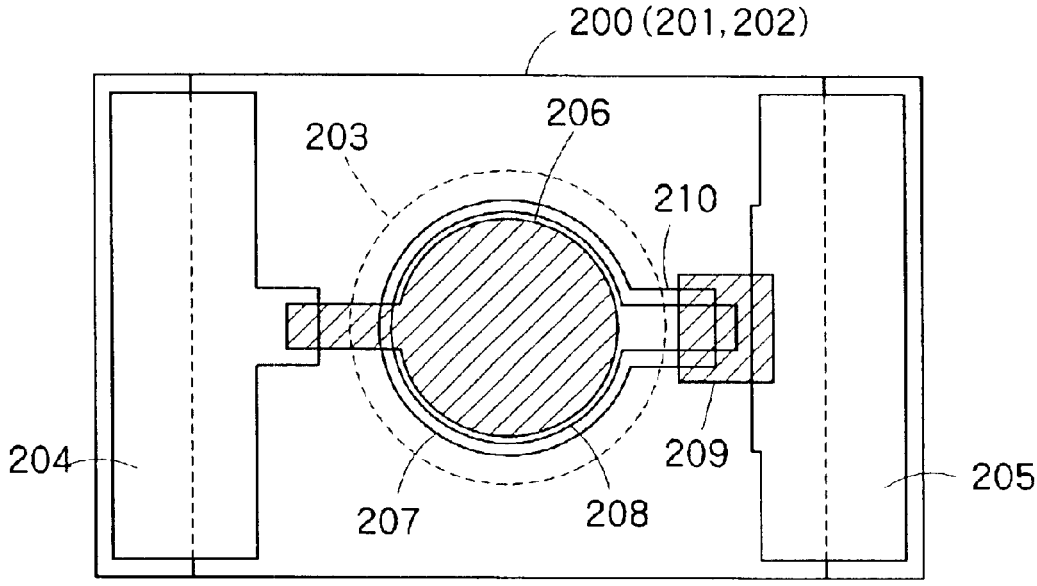
FIG. 19 is a drawing showing a conventional piezo-electric device.
Figure 20:
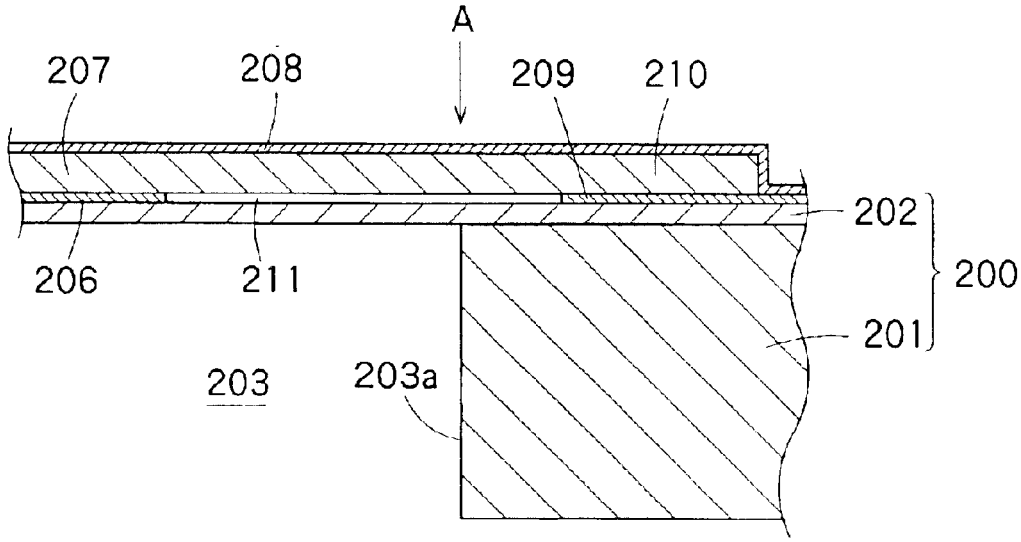
FIG. 20 is a sectional view showing an enlarged part of the conventional piezo-electric device shown in FIG. 19.

FIG. 17 shows an example that in the example shown in FIG. 14, the shape of the piezo-electric layer 47 is changed and FIG. 18 shows an example that in the example shown in FIG. 16, the shape of the piezo-electric layer 47 is changed.

In the examples shown in FIGS. 17 and 18, the piezo-electric layer 47, the lower electrode layer 46, the upper electrode layer 49, and the auxiliary electrode layer 48, as a whole, are formed in an almost symmetrical shape having the symmetrical axes $O_1$ and $O_2$ passing through the center of the body 47*a* of the piezo-electric layer 47. When a plurality of members constituting the piezo-electric device 60 are arranged in a symmetrical shape as a whole like this, the vibration characteristic of the piezo-electric device 60 can be improved. Especially, when the piezo-electric layer 47, the lower electrode layer 46, the upper electrode layer 49, and the auxiliary electrode layer 48 positioned in the region corresponding to the cavity 43 are made symmetric as a whole, the vibration characteristic of the piezo-electric device 60 is improved.

Particularly, the piezo-electric layer 47 has a comparatively large weight compared with the lower electrode layer 46, the upper electrode layer 49, and the auxiliary electrode layer 48, so that when the piezo-electric layer 47 is made symmetric, the vibration characteristic can be improved greatly.

As mentioned above, according to the present invention, the insulating gap formed between the first electrode layer and the auxiliary electrode layer is formed away from the position corresponding to the periphery of the cavity, so that when the vibration part is vibrated by driving the piezo-electric device, the stress concentration generated in the piezo-electric layer at the position corresponding to the periphery of the cavity can be greatly suppressed. Therefore, a generation of cracks in the piezo-electric layer and the upper electrode layer can be prevented.

According to the present invention, the first electrode layer, second electrode layer, and auxiliary electrode layer positioned in the region corresponding to the cavity are formed, as a whole, in an almost symmetrical shape having at least one axis of symmetry passing the center of the body of the piezo-electric layer, so that the vibration characteristic of the piezo-electric device can be improved.

According to the present invention, the piezo-electric layer positioned in the region corresponding to the cavity is formed in an almost symmetrical shape having at least one axis of symmetry passing the center of the body of the piezo-electric layer, so that the vibration characteristic of the piezo-electric device can be improved.

What is claimed is:

1. A piezo-electric device comprising:

a base having a first surface and a second surface positioned opposite to each other, said base including a cavity for receiving a medium to be detected, said cavity having a bottom and being formed so as to be opened on a side of said first surface, said bottom of said cavity being formed so as to vibrate, a first electrode layer formed on a side of said second surface, said first electrode having a body formed in a region corresponding to said cavity, a piezo-electric layer laminated on said first electrode layer, said piezo-electric layer having a body formed in a region corresponding to said cavity and an extension part extending from said body beyond a position corresponding to a periphery of said cavity, an auxiliary electrode layer formed on a side of said second surface of said base, at least a part of said auxiliary electrode layer being positioned between said second surface and said extension part of said piezo-electric layer so as to support said extension part of said piezo-electric layer, and a second electrode layer laminated on said piezo-electric layer and connected to said auxiliary electrode layer, wherein, between said first electrode layer and said auxiliary electrode layer, an insulating gap for ensuring an insulating state between said first electrode layer and said auxiliary electrode layer is formed, said insulating gap being formed away from said position corresponding to said periphery of said cavity.

2. The piezo-electric device according to claim 1, wherein said insulating gap is positioned as a whole in a region corresponding to said cavity.

3. The piezo-electric device according to claim 2, wherein said auxiliary electrode layer has a projection projected from an outside of said region corresponding to said cavity to an inside thereof beyond said position corresponding to said periphery of said cavity.

4. The piezo-electric device according to claim 3, wherein said projection of said auxiliary electrode layer has round corners.

5. The piezo-electric device according to claim 3, wherein said projection of said auxiliary electrode layer is formed wider than said extension part of said piezo-electric layer.

6. The piezo-electric device according to claim 3, wherein said projection of said auxiliary electrode layer is fonned narrower than said extension part of said piezo-electnc layer.

7. The piezo-electric device according to claim 1, wherein said first electrode layer has an extension part extending from an inside of said region corresponding to said cavity toward said auxiliary electrode layer beyond said position corresponding to said periphery of said cavity; and wherein said insulating gap is formed between said extension part of said first electrode layer and said auxiliary electrode layer and positioned as a whole outside said region corresponding to said cavity.

8. The piezo-electric device according to claim 1, wherein a portion of said first electrode layer, a portion of said second electrode layer, and a portion of said auxiliary electrode layer, which are positioned in said region corresponding to said cavity, are fanned as a whole in an almost symmetrical shape having at least one axis of symmetry passing a center of said body of said piezo-electric layer.

9. The piezo-electric device according to claim 8, wherein a portion of said piezo-electric layer positioned in said region corresponding to said cavity is fanned in an almost symmetrical shape having said at least one axis of symmetry.

10. The piezo-electric device according to claim 8, wherein said at least one axis of symmetry includes a first axis of symmetry extending in an extension direction of said extension part of said piezo-electric layer and p second axis of synirnetiy orthogonal to said first axis of symmetry.

11. An ink cartridge used for an ink jet recording apparatus, comprising:

an ink container for containing ink; and a piezo-electric device as defined in claim 10, wherein said cavity of said piezo-electric device is exposed in an ink containing space of said ink container.

12. An ink cartridge used for an ink jet recording apparatus, comprising:

an ink container for containing ink; and a piezo-electric device as defined in claim 1, wherein said cavity of said piezo-electric device is exposed in an ink containing space of said ink container.

13. A piezo-electric device comprising:

a base having a first surface and a second surface positioned opposite to each other, said base including a cavity for receiving a medium to be detected, said cavity having a bottom and being formed so as to be opened on a side of said first surface, said bottom of said cavity being formed so as to vibrate, a first electrode layer formed on a side of said second surface, said first electrode having a body formed in a region corresponding to said cavity, a piezo-electric layer laminated on said first electrode layer, said piezo-electric layer having a body formed in said region corresponding to said cavity and an extension part extending from said body beyond a position corresponding to a periphery of said cavity, an auxiliary electrode layer formed on a side of said second surface of said base, at least a part of said auxiliary electrode being positioned between said second surface and said extension part of said piezo-electric layer so as to support said extension part of said piezo-electric layer, and a second electrode layer laminated on said piezo-electric layer and connected to said auxiliary electrode layer, wherein a portion of said first electrode layer, a portion of said second electrode layer, and a portion of said auxiliary electrode layer, which are positioned in said region corresponding to said cavity, are formed as a whole in an almost symmetrical shape having at least one axis of symmetry passing a center of said body of said piezo-electric layer.

14. The piezo-electric device according to claim 13, wherein a portion of said piezo-electric layer positioned in said region corresponding to said cavity is formed in an almost symmetrical shape having said at least one axis of symmetry.

15. An ink cartridge used for an ink jet recording apparatus, comprising: an ink container for containing ink; and a piezo-electric device as defined in claim 14, wherein said cavity of said piezo-electric device is exposed in an ink containing space of said ink container.

16. The piezo-electric device according to claim 13, wherein said at least one axis of symmetry includes a first axis of symmetry extending in an extension direction of said extension part of said piezo-electric layer and a second axis of symmetry orthogonal to said first axis of symmetry.

17. A piezo-electric device comprising:

a base having a first surface and a second surface positioned opposite to each other, said base including a cavity for receiving a medium to be detected, said cavity having a bottom and being formed so as to be opened on a side of said first surface, said bottom of said cavity being formed so as to vibrate, a first electrode layer formed on a side of said second surface, said first electrode having a body formed in a region corresponding to said cavity, a piezo-electric layer laminated on said first electrode layer, said piezo-electric layer having a body formed in a region corresponding to said cavity and an extension part extending from said body beyond a position corresponding to a periphery of said cavity, an auxiliary electrode layer formed on a side of said second surface of said base, at least a part of said auxiliary electrode layer being positioned between said second surface and said extension part of said piezo-electric layer so as to support said extension part of said piezo-electric layer, and a second electrode layer laminated on said piezo-electric layer and connected to said auxiliary electrode layer, wherein a portion of said piezo-electric layer positioned in said region corresponding to said cavity is formed in an almost symmetrical shape having at least one axis of symmetry passing a center of said body of said piezo-electric layer.

18. The piezo-electric device according to claim 17, wherein said at least one axis of symmetry includes a first axis of symmetry extending in an extension direction of said extension part of said piezo-electric layer and a second axis of symmetry orthogonal to said first axis of symmetry.

19. A piezo-electric device comprising:

a base having a first surface and a second surface positioned opposite to each other, said base including a cavity for receiving a medium to be detected, said cavity having a bottom and being formed so as to be opened on a side of said lust surface, said bottom of said cavity being formed so as to vibrate, a first electrode layer formed on a side of said second surface, said first electrode having a body formed in a region corresponding to said cavity, a piezo-electric layer laminated on said first electrode layer, said piezo-electric layer having a body formed in a region corresponding to said cavity and an extension part extending from said body beyond a position corresponding to a periphery of said cavity, an auxiliary electrode layer formed on a side of said second surface of said base, at least a part of said auxiliary electrode layer being positioned between said second surface an said extension part of said piezo-electric layer so as to support said extension part of said piezo-electric layer, and a second electrode layer laminated on said piezo-electric layer and connected to said auxiliary electrode layer, wherein, between said first electrode layer and said auxiliary electrode layer, an insulating gap for ensuring an insulating state between said first electrode layer and said auxiliary electrode layer is formed, said insulating gap being formed away from said position corresponding to said periphery of said cavity; and wherein, a portion of said piezo-electric layer positioned in said region corresponding to said cavity is formed in an almost symmetrical shape having at least two axes of symmetry.

20. The piezo-electric device according to claim 19, wherein said at least two axes of symmetry includes a first axis of symmetry and a second axis of symmetry orthogonal to said first axis of symmetry.

21. The piezo-electric device according to claim 20, wherein said first axis of symmetry extends in an extension direction of said extension part of said piezo-electric layer.

* * * * *